US012760957B2

(12) United States Patent
Jang et al.

(10) Patent No.: US 12,760,957 B2
(45) Date of Patent: Oct. 13, 2026

(54) REFRIGERATOR

(71) Applicant: SAMSUNG ELECTRONICS CO., LTD., Suwon-si (KR)

(72) Inventors: Wonho Jang, Suwon-si (KR); Inyong Hwang, Suwon-si (KR); Jonghoon Oh, Suwon-si (KR); Chulhee Kim, Suwon-si (KR); Subin Yun, Suwon-si (KR); Seongchan Lee, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 18/677,649

(22) Filed: May 29, 2024

(65) Prior Publication Data

US 2024/0318896 A1 Sep. 26, 2024

Related U.S. Application Data

(63) Continuation of application No. PCT/KR2022/016367, filed on Oct. 25, 2022.

(30) Foreign Application Priority Data

Dec. 23, 2021 (KR) ..... 10-2021-0185597

(51) Int. Cl.
*F25D 23/02* (2006.01)

(52) U.S. Cl.
CPC ..... *F25D 23/028* (2013.01); *F25D 2201/10* (2013.01); *F25D 2323/024* (2013.01)

(58) Field of Classification Search
None
See application file for complete search history.

(56) References Cited

U.S. PATENT DOCUMENTS 9,134,062 B2 * 9/2015 Jung ..... F25D 23/087
9,157,676 B2 * 10/2015 Lee ..... F25D 23/12
(Continued)

FOREIGN PATENT DOCUMENTS

CN 203758143 U * 8/2014
CN 104279823 A * 1/2015 ..... F25D 23/028
(Continued)

OTHER PUBLICATIONS

International Search Report and Written Opinion of the International Searching Authority dated Feb. 14, 2023, in connection with International Application No. PCT/KR2022/016367, 10 pages.

*Primary Examiner* — Hanh V Tran

(57) ABSTRACT

A refrigerator includes an outer case, an inner case forming a storage compartment and including a guide receiving space, and a guide mounting groove, an insulation between the outer and inner cases, a first door rotatably coupled to the outer case to cover a portion of the storage compartment, a second door rotatably coupled to the outer case to cover another portion of the storage compartment, a bar rotatable with one of the first and second doors and cover a gap between the first and second doors, and a rotation guide disposed on an upper portion of the storage compartment to guide the bar to allow rotation of the bar in response to opening or closing of the first or second door and including a guide body partially accommodated in the guide receiving space and a protrusion inserted into the guide mounting groove to prevent movement of the rotation guide.

15 Claims, 15 Drawing Sheets

(56) References Cited

U.S. PATENT DOCUMENTS

| | | | | |
|---|---|---|---|---|
| 9,506,689 | B2 | 11/2016 | Carbajal et al. | |
| 9,874,391 | B2 | 1/2018 | Jung | |
| 10,429,121 | B2 | 10/2019 | Yoon et al. | |
| 10,753,672 | B2 * | 8/2020 | Ham | F25D 23/02 |
| 10,808,982 | B2 * | 10/2020 | Hanson | F25D 23/028 |
| 10,837,695 | B2 * | 11/2020 | Baum | B67D 1/0857 |
| 12,044,463 | B2 * | 7/2024 | Jia | F25D 23/028 |
| 2012/0137722 | A1 * | 6/2012 | Kim | F25D 23/028 62/440 |
| 2019/0178555 | A1 | 6/2019 | Hanson | |
| 2021/0318059 | A1 * | 10/2021 | Hosamani | F25D 23/028 |
| 2024/0060710 | A1 * | 2/2024 | Hwang | F25D 25/025 |

FOREIGN PATENT DOCUMENTS

| | | | | | |
|---|---|---|---|---|---|
| CN | 104344652 | A | * | 2/2015 | F25D 23/028 |
| CN | 103292540 | B | * | 9/2015 | F25D 23/028 |
| CN | 103307840 | B | * | 9/2015 | F25D 23/028 |
| CN | 105333668 | A | * | 2/2016 | |
| CN | 105466122 | A | * | 4/2016 | F25D 23/028 |
| CN | 105698473 | A | * | 6/2016 | F25D 23/02 |
| CN | 105737489 | A | * | 7/2016 | F25D 23/028 |
| CN | 106091533 | A | * | 11/2016 | F25D 23/10 |
| CN | 205718144 | U | * | 11/2016 | |
| CN | 106352651 | A | * | 1/2017 | F25D 23/028 |
| CN | 106524623 | A | * | 3/2017 | F25D 11/00 |
| CN | 106595206 | A | * | 4/2017 | F25D 11/00 |
| CN | 206755699 | U | * | 12/2017 | |
| CN | 105222487 | B | * | 2/2018 | |
| CN | 107917571 | A | * | 4/2018 | B23P 19/00 |
| CN | 108106311 | A | * | 6/2018 | F25D 23/028 |
| CN | 109539676 | A | * | 3/2019 | F25D 23/028 |
| CN | 107917571 | B | * | 4/2020 | B23P 19/00 |
| CN | 212205296 | U | * | 12/2020 | |
| CN | 212253341 | U | * | 12/2020 | F25D 23/028 |
| CN | 213273350 | U | * | 5/2021 | |
| CN | 118103653 | A | * | 5/2024 | F25D 21/04 |
| DE | 102016202570 | A1 | * | 8/2017 | F25D 23/028 |
| EP | 2610566 | A2 | * | 7/2013 | F25D 23/028 |
| EP | 2686625 | B1 | | 9/2015 | |
| EP | 2823735 | B1 | | 4/2017 | |
| JP | 3199390 | B2 | | 8/2001 | |
| JP | 3394526 | B2 | | 4/2003 | |
| KR | 10-0615797 | B1 | | 8/2006 | |
| KR | 20-2008-0004988 | U | | 10/2008 | |
| KR | 10-0894480 | B1 | | 4/2009 | |
| KR | 10-2011-0072774 | A | | 6/2011 | |
| KR | 10-2012-0039887 | A | | 4/2012 | |
| KR | 10-2016-0062861 | A | | 6/2016 | |
| KR | 10-2017-0020118 | A | | 2/2017 | |
| KR | 10-1863930 | B1 | | 6/2018 | |
| KR | 10-2018-0086733 | A | | 8/2018 | |
| KR | 10-1998566 | B1 | | 7/2019 | |
| KR | 10-2020-0021823 | A | | 3/2020 | |
| WO | 2011037410 | A2 | | 3/2011 | |

* cited by examiner

REFRIGERATOR

CROSS-REFERENCE TO RELATED APPLICATIONS

This application is a Bypass Continuation application of International Application No. PCT/KR2022/016367, filed Oct. 25, 2022, which claims priority to Korea patent application No. 10-2021-0185597 filed Dec. 23, 2021, in the Korean intellectual property office, the disclosures of which are incorporated by reference herein in their entirety.

BACKGROUND

1. Field

The disclosure relates to a refrigerator, and more particularly to a refrigerator including a rotating bar.

2. Description of Related Art

In general, a refrigerator, a device for keeping food fresh, includes a main body having a storage compartment, a cold air supply device for supplying cold air to the storage compartment, and a door for opening and closing the storage compartment.

Typically, the storage compartment has an open front for putting food in and out, and the open front of the storage compartment is opened and closed by a door. When the door is opened, cold air in the storage compartment escapes to the outside and warm air outside the storage compartment enters the storage compartment, resulting in an increase in the temperature of the storage compartment.

The temperature of the storage compartment needs to be maintained in a certain range to keep food fresh. An increase in the temperature of the storage compartment may cause problems in keeping food fresh, and additional energy may be required to bring the temperature of the storage compartment down to a normal level.

On the other hand, a French door refrigerator (hereinafter referred to as an FDR refrigerator) may include a rotating bar rotatably coupled to a left or right door to prevent cold air from leaking through a gap between the left and right doors.

A main body of the FDR refrigerator may be provided with a rotation guide that guides the rotation of the rotating bar to allow the rotating bar to rotate in response to the opening and closing of the door.

SUMMARY

The present disclosure is directed to a refrigerator having an improved structure to prevent errors at a position where a rotation guide is coupled to an inner case.

According to an embodiment of the disclosure, a refrigerator may include an outer case forming an exterior thereof, an inner case forming a storage compartment and including a guide receiving space and a guide mounting groove formed integrally with the inner case, an insulation foamed between the outer case and the inner case, a first door rotatably coupled to the outer case to open or close at least a portion of the storage compartment, a second door disposed on a right side of the first door and rotatably coupled to the outer case to open or close at least another portion of the storage compartment, a rotating bar configured to be rotatable with respect to one of the first door and the second door and cover a gap between the first door and the second door when the first door and the second door are closed, and a rotation guide disposed on an upper portion of the storage compartment to guide the rotating bar to allow rotation of the rotating bar in response to opening or closing of the first door or the second door, and including a guide body at least partially accommodated in the guide receiving space and an insertion protrusion inserted into the guide mounting groove to prevent movement of the rotation guide.

The insertion protrusion may be disposed on a rear side of the guide body.

The insertion protrusion may be inserted into the guide mounting groove in a direction from a lower portion toward an upper portion of the inner case.

The inner case may include a surface forming the guide mounting groove, wherein the surface includes a first surface, a second surface disposed to face the first surface, a plurality of third surfaces connecting the first surface and the second surface, and an insertion surface disposed in a direction in which the insertion protrusion is inserted into the guide mounting groove, and an outer surface of the insertion protrusion may be formed to contact at least a portion of the first surface, at least a portion of the second surface, and at least a portion of each of the plurality of third surfaces.

The insertion protrusion may include a connection portion connected to the guide body and an insertion portion inserted into the guide mounting groove, and the insertion portion may extend from the connection portion in a direction in which the insertion portion is inserted into the guide mounting groove.

The connection portion may extend rearwardly from the guide body, and the insertion portion may extend upwardly from the connection portion.

The insertion portion may extend from a first end opposite to a second end on a side of the connection portion adjacent to the guide body.

The insertion portion may include a first wall, a second wall disposed to face the first wall, and a third wall connecting the first wall and the second wall, the first wall, the second wall, and the third wall may form at least a portion of an outer surface of the insertion portion and be formed to extend in the direction in which the insertion portion is inserted into the guide mounting groove.

The insertion portion may include an interference protrusion formed to protrude toward an inner surface of the guide mounting groove from at least a portion of the first wall, the second wall, and the third wall, and the interference protrusion may interfere with the inner surface of the guide mounting groove when the insertion portion is inserted into the guide mounting groove.

The interference protrusion may protrude in a direction different from the direction in which the insertion portion is inserted into the guide mounting groove.

The insertion protrusion may include a rib configured to support an inner surface of the insertion protrusion therein.

At least a portion of the rib may extend inside the connection portion along a direction in which the connection portion extends from the guide body, and at least another portion of the rib may extend inside the insertion portion along a direction in which the insertion portion extends from the connection portion.

The guide body may include a guide fastening hole formed to fasten the rotation guide to the inner case.

The guide fastening hole may fasten the rotation guide to the inner case in a direction in which the insertion protrusion is inserted into the guide mounting groove.

The guide body may further include a guide groove guiding the rotation of the rotating bar, and the rotating bar may include a guide protrusion moving along the guide groove so as to guide the rotation of the rotating bar.

According to an embodiment of the disclosure, a refrigerator may include an outer case forming an exterior thereof, an inner case forming a storage compartment and including a guide mounting groove formed integrally with the inner case, a guide receiving space, and an inner case fastening hole, an insulation foamed between the outer case and the inner case, a door to open or close the storage compartment and including a first door and a second door adjacent to the first door, a rotating bar rotatably coupled to one of the first door and the second door and formed to cover a gap between the first door and the second door when the first door and the second door are closed, and a rotation guide to guide the rotating bar to allow rotation of the rotating bar in response to opening or closing of the one of the first door or the second door to which the rotating bar is coupled, the rotation guide including a guide body having at least a portion thereof accommodated in the guide receiving space, a guide fastening hole formed to be screwed into the inner case fastening hole, and an insertion protrusion inserted into the guide mounting groove to constrain the rotating guide from movement.

The insertion protrusion may be inserted into the guide mounting groove in a vertical direction.

The insertion protrusion may include a connection portion connected to the guide body and an insertion portion inserted into the guide mounting groove and extending from a first end opposite to a second end on a side of the connection portion adjacent to the guide body.

The insertion portion may include an interference protrusion formed to protrude toward an inner surface of the guide mounting groove and interfering with the inner surface of the guide mounting groove.

The guide fastening hole and the inner case fastening hole may be aligned with a direction in which the insertion protrusion is inserted into the guide mounting groove.

According to aspects of the present disclosure, the insertion protrusion of the rotation guide may be inserted into the guide mounting groove formed integrally with the inner case before the rotation guide is fastened to the inner case, thereby fixing the position at which the rotation guide is coupled to the inner case.

According to aspects of the present disclosure, an error in the position at which the rotation guide is coupled to the inner case may be reduced, thereby preventing cold air from leaking through the gap between adjacent doors.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one.

Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

For a more complete understanding of the present disclosure and its advantages, reference is now made to the following description taken in conjunction with the accompanying drawings, in which like reference numerals represent like parts.

DETAILED DESCRIPTION

Figure 1:
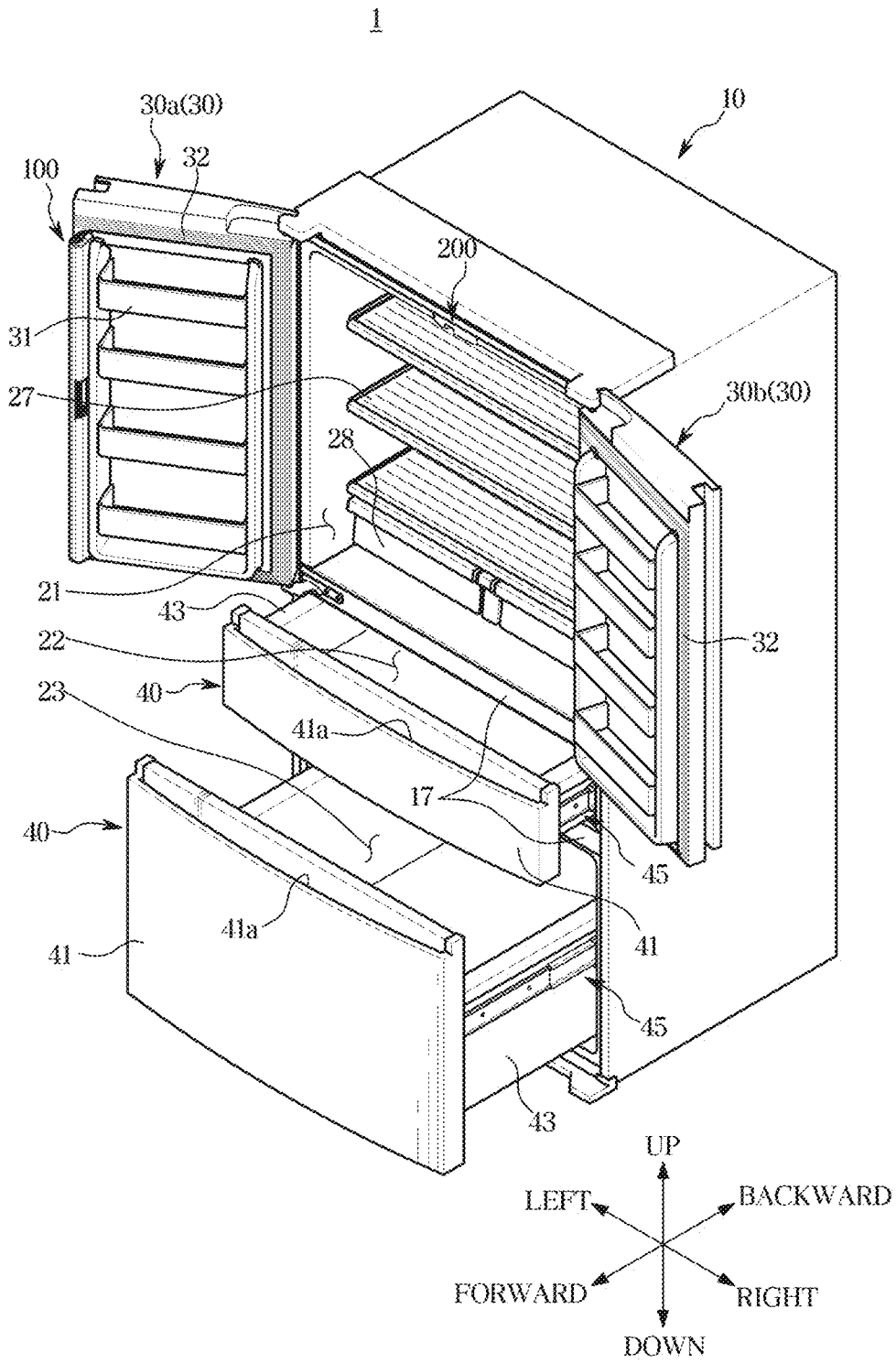
FIG. 1 is a perspective view illustrating a refrigerator according to an embodiment of the present disclosure.

Embodiments described in the disclosure and configurations shown in the drawings are merely examples of the embodiments of the disclosure and may be used in various different ways at the time of filing of the present application to replace the embodiments and drawings of the disclosure.

In addition, the same reference numerals or signs shown in the drawings of the disclosure indicate elements or components performing substantially the same function.

Also, the terms used herein are used to describe the embodiments and are not intended to limit and/or restrict the disclosure. The singular forms "a," "an" and "the" are intended to include the plural forms as well, unless the context clearly indicates otherwise. In this disclosure, the terms "including", "having", and the like are used to specify features, figures, steps, operations, elements, components, or combinations thereof, but do not preclude the presence or addition of one or more of the features, figures, steps, operations, elements, components, or combinations thereof.

It will be understood that, although the terms "first", "second", "primary", "secondary", etc., may be used herein to describe various elements, but elements are not limited by these terms. These terms are only used to distinguish one element from another element. For example, without departing from the scope of the disclosure, a first element may be termed as a second element, and a second element may be termed as a first element. The term of "and/or" includes a plurality of combinations of relevant items or any one item among a plurality of relevant items.

Hereinafter, various embodiments according to the disclosure will be described in detail with reference to the accompanying drawings.

Figure 2:
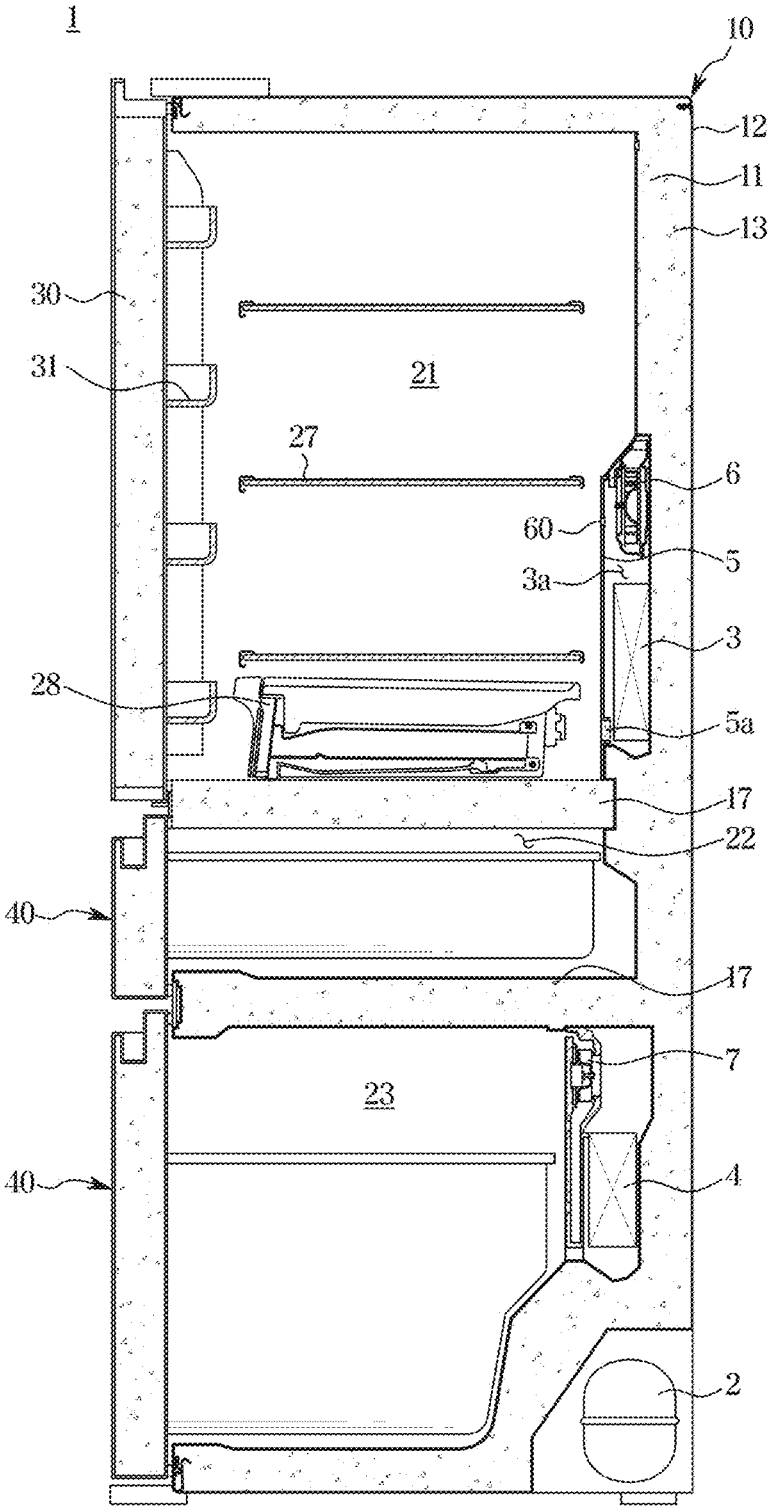
FIG. 2 is a schematic side view of the refrigerator of FIG. 1.

FIG. 1 is a perspective view showing a refrigerator according to an embodiment of the present disclosure. FIG. 2 is a schematic side cross-sectional view of the refrigerator of FIG. 1.

Referring to FIGS. 1 and 2, a refrigerator 1 may include a main body 10 having storage compartments 21, 22, and 23, doors 30 and 40 provided to open or close the storage compartments 21, 22, and 23, and a cold air supply device supplying cold air to the storage compartments 21, 22, and 23.

The main body 10 may include an inner case 11 forming the storage compartments 21, 22, and 23, an outer case 12 coupled to an outer side of the inner case 11, and an insulation 13 provided between the inner case 11 and the outer case 12. The inner case 11 may be formed of a plastic material, and the outer case 12 may be formed of a metallic material. The insulation 13 may include urethane foam insulation, and if necessary, a vacuum insulation panel may be used together. The insulation 13 may be foamed between the inner case 11 and the outer case 12, thereby coupling the inner case 11 and the outer case 12 together. The main body 10 may have a partition 17 that divides the storage compartments 21, 22, and 23 in a vertical direction.

The storage compartments 21, 22, and 23 may be used as a refrigerating compartment maintained at approximately 0 to 5 degrees Celsius for keeping food refrigerated, and a freezing compartment maintained at approximately −30 to 0 degrees Celsius for keeping food frozen.

The storage compartments 21, 22, and 23 may have an open front to allow food to be put in and taken out, and the open front of the storage compartments 21, 22, and 23 may be opened or closed by the doors 30 and 40. The storage compartments 21, 22, and 23 may be provided with shelves 27 on which food may be placed and storage containers 28 on which food may be stored.

The door 30 may be arranged to open or close a first storage compartment 21. The door 30 may be coupled to the main body 10 so as to be rotatable in a left-to-right direction. In particular, the door 30 may be rotatably coupled to the outer case 12 of the main body 10. One or more door shelves 31 for storing food may be provided on a rear surface of the door 30.

The door 30 may be provided with a gasket 32 formed on an inner side of the door 30 where the door 30 faces the first storage compartment 21, wherein the gasket 32 may seal a gap between the door 30 and the main body 10 to prevent cold air from leaking from the first storage compartment 21. The gasket 32 may be formed along a circumference of the door 30 on an inner surface of the door 30. The gasket 32 may be configured as a material, such as rubber.

The door 30 may include a plurality of doors 30*a* and 30*b*, and the plurality of doors 30*a* and 30*b* may be arranged adjacent to each other. In particular, the plurality of doors 30*a* and 30*b* may be disposed adjacent to each other in the left-to-right direction. Of the plurality of doors 30*a* and 30*b*, the door 30*a* located on the left side may be referred to as a first door 30*a*, and the door 30*b* located on the right side of the first door 30*b* may be referred to as a second door 30*b*. The designations for the first door 30*a* and the second door 30*b* are for ease of description, and the configuration or function of the doors 30*a* and 30*b* may not be limited by such designations.

The first door 30*a* may be rotatably coupled to the main body 10 to open or close at least a portion of the first storage compartment 21. The second door 30*b* may be rotatably coupled to the main body 10 to open or close at least another portion of the first storage compartment 21 that is not opened or closed by the first door 30*a*.

A rotating bar 100 may be rotatably mounted on one of the doors 30 to cover a gap formed between the doors 30 when the door 30 is closed. In other words, the rotating bar 100 may be rotatably arranged on the first door 30*a* or the second door 30*b*, and when the first door 30*a* and the second door 30*b* are closed, the rotating bar 100 may be formed to cover a gap between the first door 30*a* and the second door 30*b*.

Although the rotating bar 100 is shown in FIG. 1 as being rotatably coupled to the first door 30*a*, the arrangement of the rotating bar 100 may be not limited thereto. It is sufficient for the rotating bar 100 to be rotatably mounted on any one of the doors 30, and, unlike that shown in FIG. 1, the rotating bar 100 may also be rotatably coupled to the second door 30*b*.

Hereinafter, for ease of description, it is assumed that the rotating bar 100 is rotatably arranged on the first door 30*a* of the doors 30. However, as described above, the arrangement of the rotating bar 100 is not limited thereto.

The rotating bar 100 may be arranged in the shape of a bar elongated along the height direction of the door 30, and may be rotated by a rotation guide 200 provided in the main body 10. The rotation guide 200 may be configured to include a guide body 210 (see FIG. 5) coupled to the main body 10, and a guide groove 211 (see FIG. 5) formed in the guide body 210.

More particularly, the rotating bar 100 may rotate to a first position disposed approximately perpendicular to the first door 30*a* when the first door 30*a* opens the first storage compartment 21. Whereas the rotating bar 100 may rotate to a second position disposed substantially parallel to the first door 30*a* when the first door 30*a* closes the first storage compartment 21. Further details of the configuration and operation of the rotating bar 100 will be described later.

The doors 40 may be slidably arranged to be inserted into the second storage compartment 22 and the third storage compartment 23 or to be withdrawn from the second storage compartment 22 and the third storage compartment 23. Each of the doors 40 may include a door portion 41 covering the open front surface of the second storage compartment 22 or the third storage compartment 23, and a basket 43 coupled to a rear surface of the door portion 41. The basket 43 may be slidably supported by rails 45. The door portion 41 may be provided with a handle 41*a*.

The cold air supply device may generate cold air using the latent heat of evaporation of refrigerant through a refrigeration cycle. The cold air supply device may include a compressor 2, a condenser, an expansion device, evaporators 3 and 4, and blowing fans 6 and 7.

The first evaporator 3 may be disposed on a rear side of the first storage compartment 21 to generate cold air. The first evaporator 3 may be accommodated in a cooling chamber 3*a* formed by an evaporator cover 5. An inlet 5*a* may be formed in the evaporator cover 5, and thus air may be drawn from the first storage compartment 21 into the cooling chamber 3*a* through the inlet 5*a*.

The first blowing fan 6 may be provided in the cooling chamber 3*a* to flow air. The cooling chamber 3*a* may be provided with a cooling outlet 60 that discharges cold air from the cooling chamber 3*a* into the interior of the first storage compartment 21. According to such a configuration, when the blowing fan 6 is operated, air from the first storage compartment 21 may be drawn into the cooling chamber 3*a* through the inlet 5*a*, and the drawn-in air may be cooled through the evaporator 3 and then be discharged into the interior of the first storage compartment 21 through the cooling outlet 60.

Figure 3:
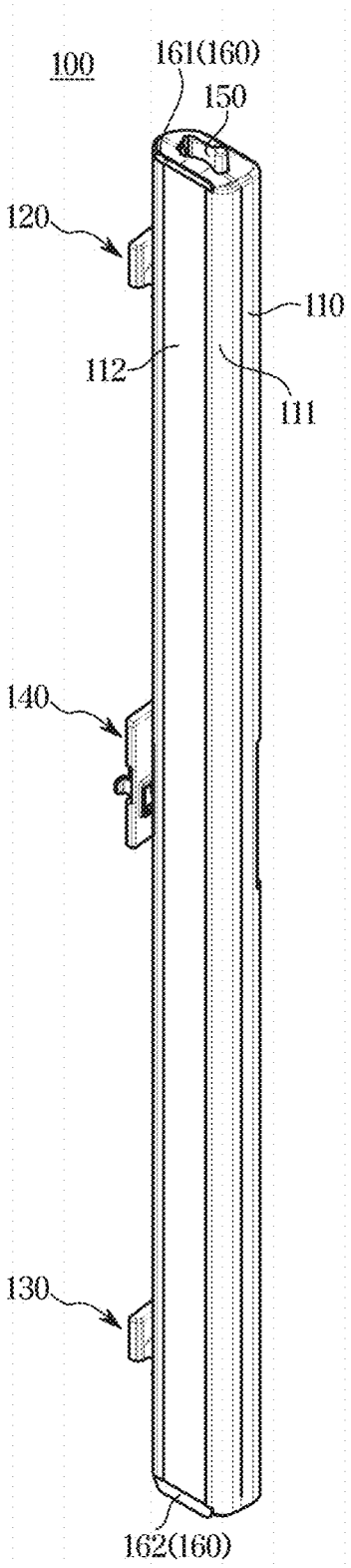
FIG. 3 is a view illustrating a rotating bar of FIG. 1.

FIG. 3 is a view showing the rotating bar shown in FIG. 1 separated from the door.

Referring to FIG. 3, the rotating bar 100 may include a case 110 having an open first side, covers 111 and 112 covering the open first side of the case 110, and hinge members 120, 130 and 140 rotatably supporting the cases 110 and the covers 111 and 112 against the door 30, and a guide protrusion 150 guided by the rotation guide 200 coupled to the main body 10. The hinge members 120, 130, and 140 may include an upper hinge member 120, a lower hinge member 130, and a middle hinge member 140.

The case 110 may form the exterior of the rotating bar 100 and may have a space formed therein to receive an insulating member. The open first side of the case 110 may be covered by a first cover 111 and a second cover 112.

The second cover 112 may be configured to include a metallic material. A heating element (not shown) may be provided between the first cover 111 and the second cover 112. The heating element may prevent frost formation on the second cover 112 due to a temperature difference between the inside and outside of the storage compartment 21.

The rotating bar 100 may include the guide protrusion 150 inserted into the guide groove 211 of the rotation guide 200. The guide protrusion 150 may be guided by the rotation guide 200. The guide protrusion 150 may be formed to have a shape that protrudes from an upper end of the rotating bar 100.

The guide protrusion 150 may enter the interior of the guide groove 211 and then rotate along a curved surface of the guide groove 211. As the guide protrusion 150 rotates, the rotating bar 100 may also rotate. In other words, in the process of closing the first door 30*a*, the rotating bar 100 may rotate from the first position perpendicular to the first door 30*a* to the second position parallel to the first door 30*a*.

However, the present disclosure is not limited thereto, and the rotating bar 100 may not include the guide protrusion 150, but may include a groove structure (not shown) that is concavely formed at the upper end of the rotating bar 100. Correspondingly, the rotation guide 200, which will be described later, may include a protrusion structure (not shown) that is formed to be inserted into the groove structure of the rotating bar 100 as the first door 30*a* is closed. The protrusion structure of the rotation guide 200 may have a shape that protrudes downwardly from the guide body 210 to guide the rotation of the rotating bar 100 as it is inserted into or removed from the groove structure of the rotating bar 100.

Meanwhile, a sealing member 160 may be provided at the upper and lower ends of the rotating bar 100 to cover the gap between the rotating bar 100 and the main body 10 when the door 30 is closed. The sealing members 160 may include an upper sealing member 161 and a lower sealing member 162. The upper sealing member 161 may cover a gap between the rotation guide 200 and the rotating bar 100, and the lower sealing member 162 may cover the gap between the main body 10 and the rotating bar 100.

However, the configuration of the rotating bar 100 is not limited to the above and may include different configurations as long as it is provided to rotate in response to the opening and closing of the door 30 to cover the gap between the first door 30*a* and the second door 30*b* when the door 30 is closed.

Figure 4:
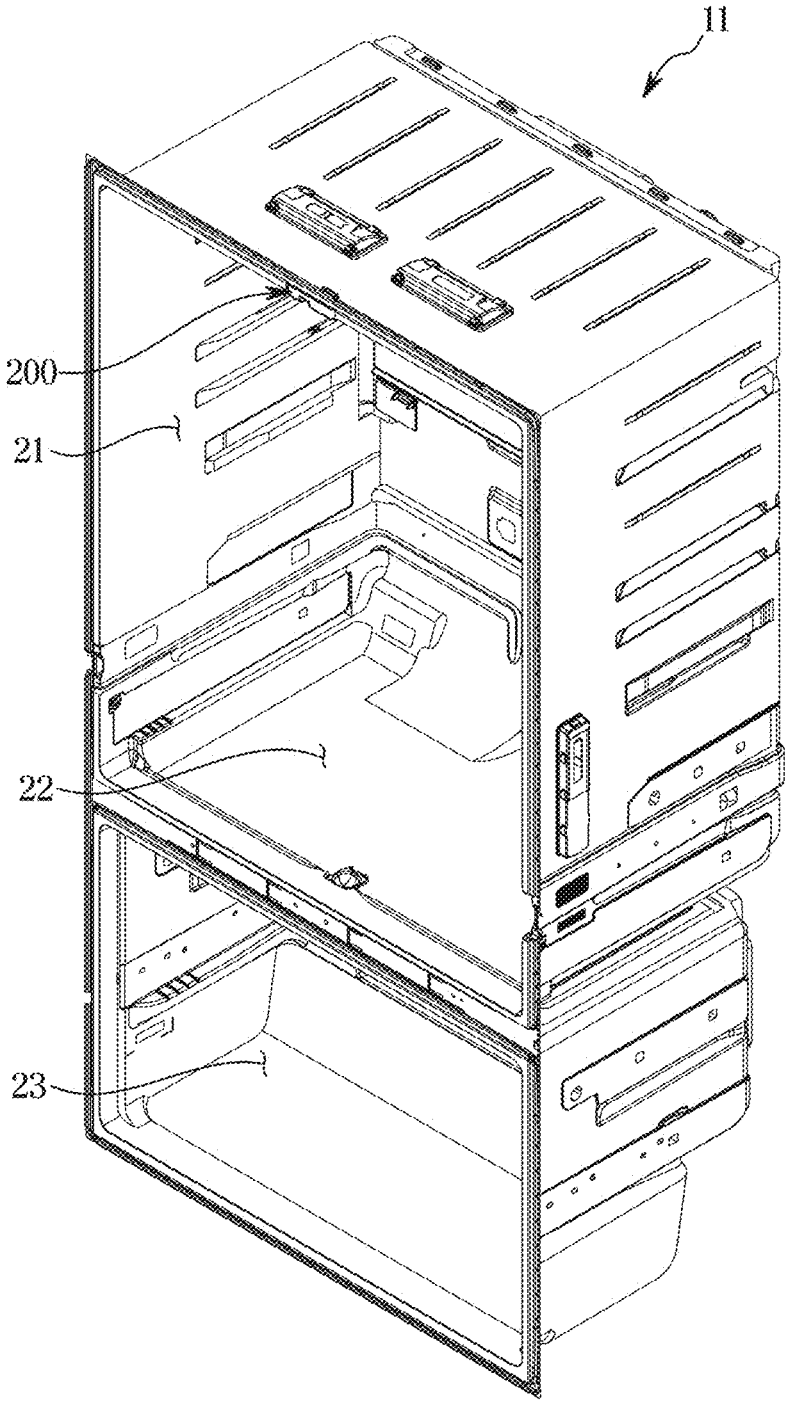
FIG. 4 is a view illustrating an inner case and a rotation guide of FIG. 1.
Figure 5:
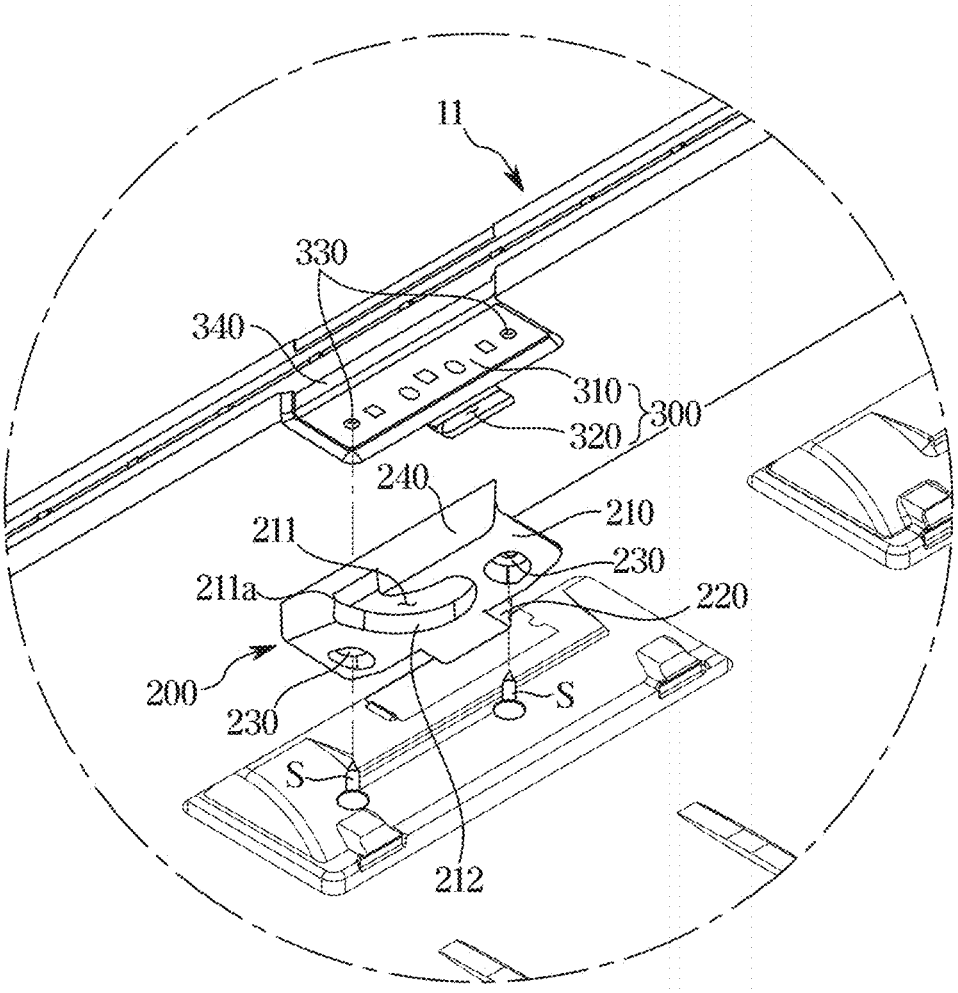
FIG. 5 is a view illustrating the coupling relationship between the inner case and the rotation guide of FIG. 1.
Figure 6:
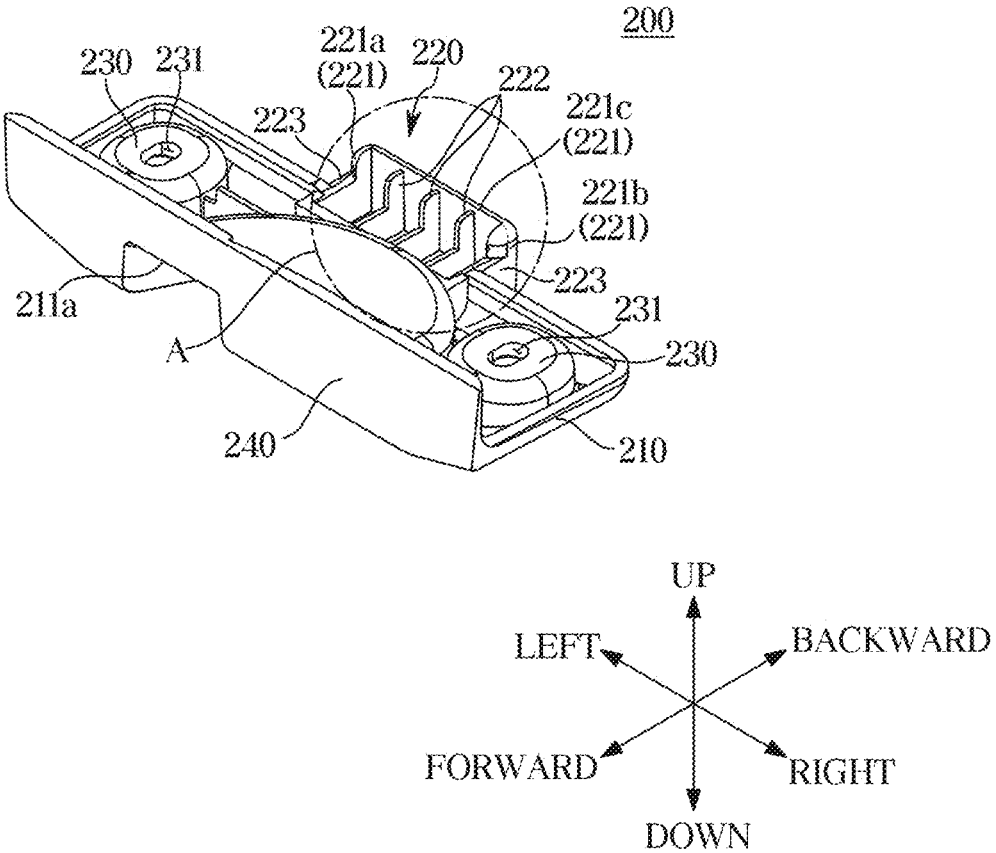
FIG. 6 is a perspective view of the rotation guide of FIG. 1.
Figure 7:
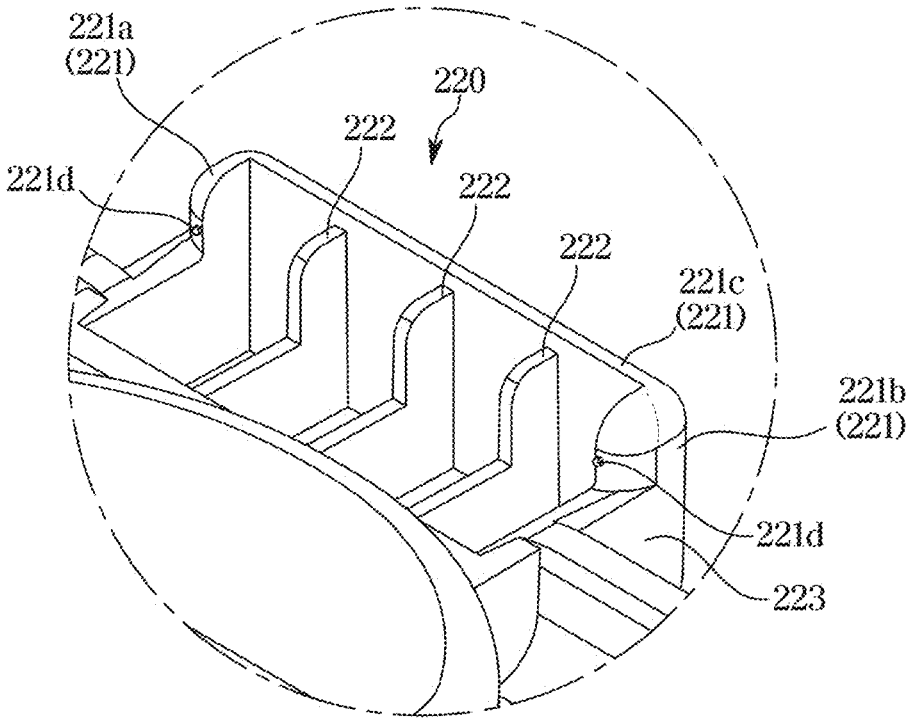
FIG. 7 is an enlarged view of A shown in FIG. 6.
Figure 8:
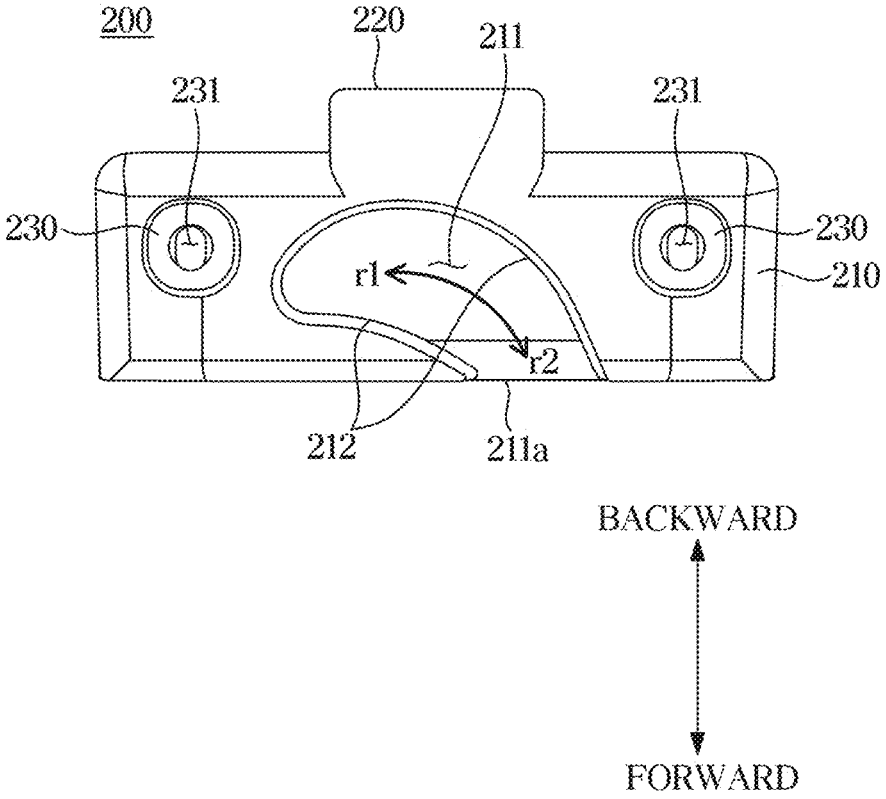
FIG. 8 is a bottom view of the rotation guide of FIG. 1.
Figure 9:
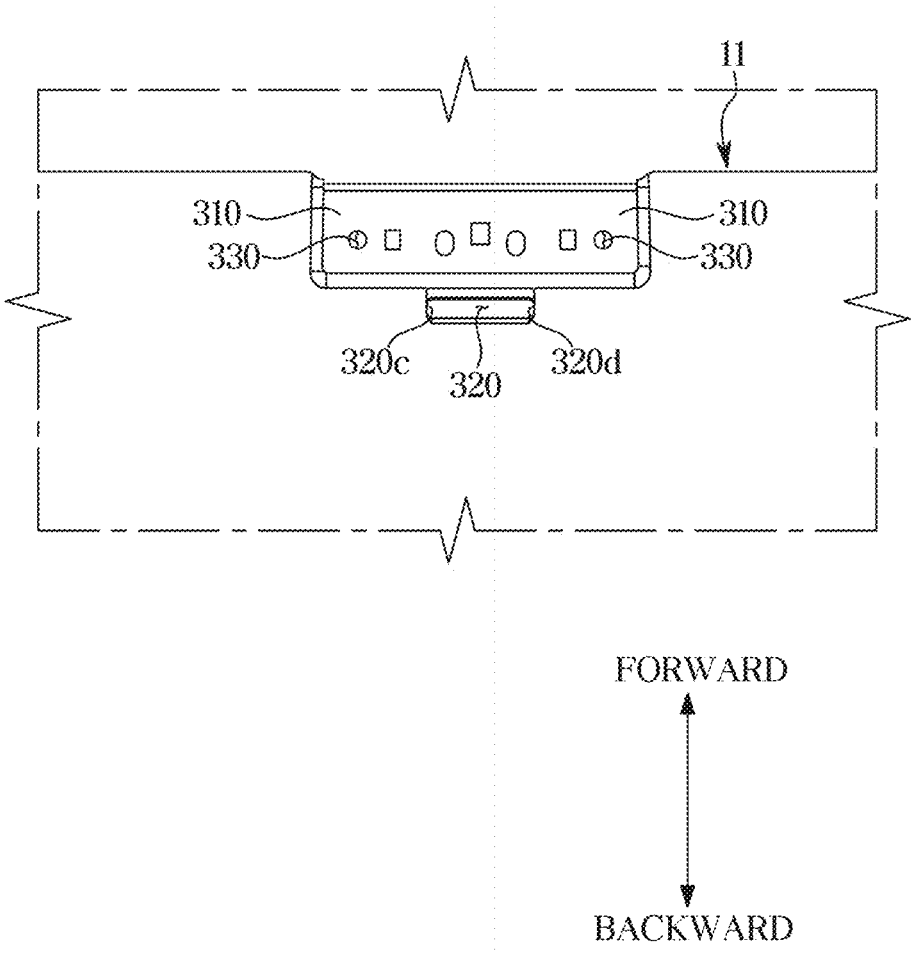
FIG. 9 is a bottom view of a guide coupling of FIG. 5.
Figure 10:
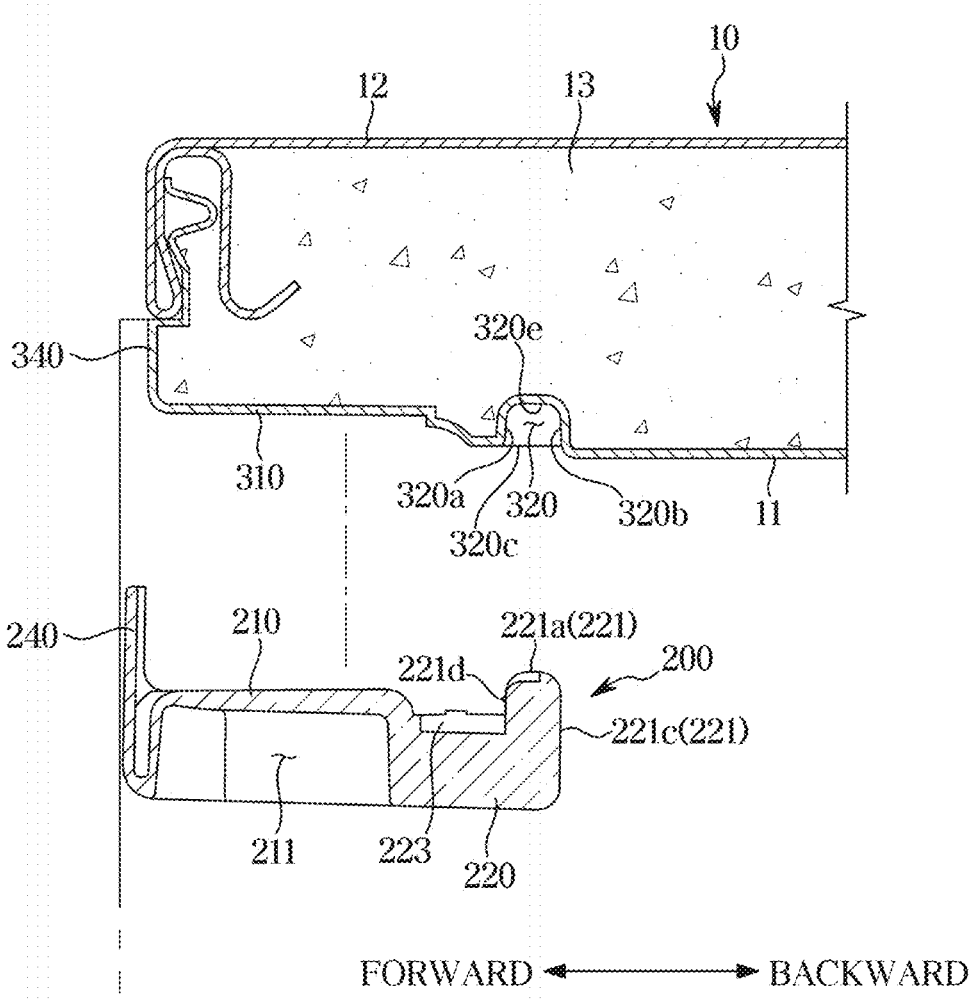
FIG. 10 is a side cross-sectional view of the inner case of FIG. 1 before the rotation guide is coupled thereto.
Figure 11:
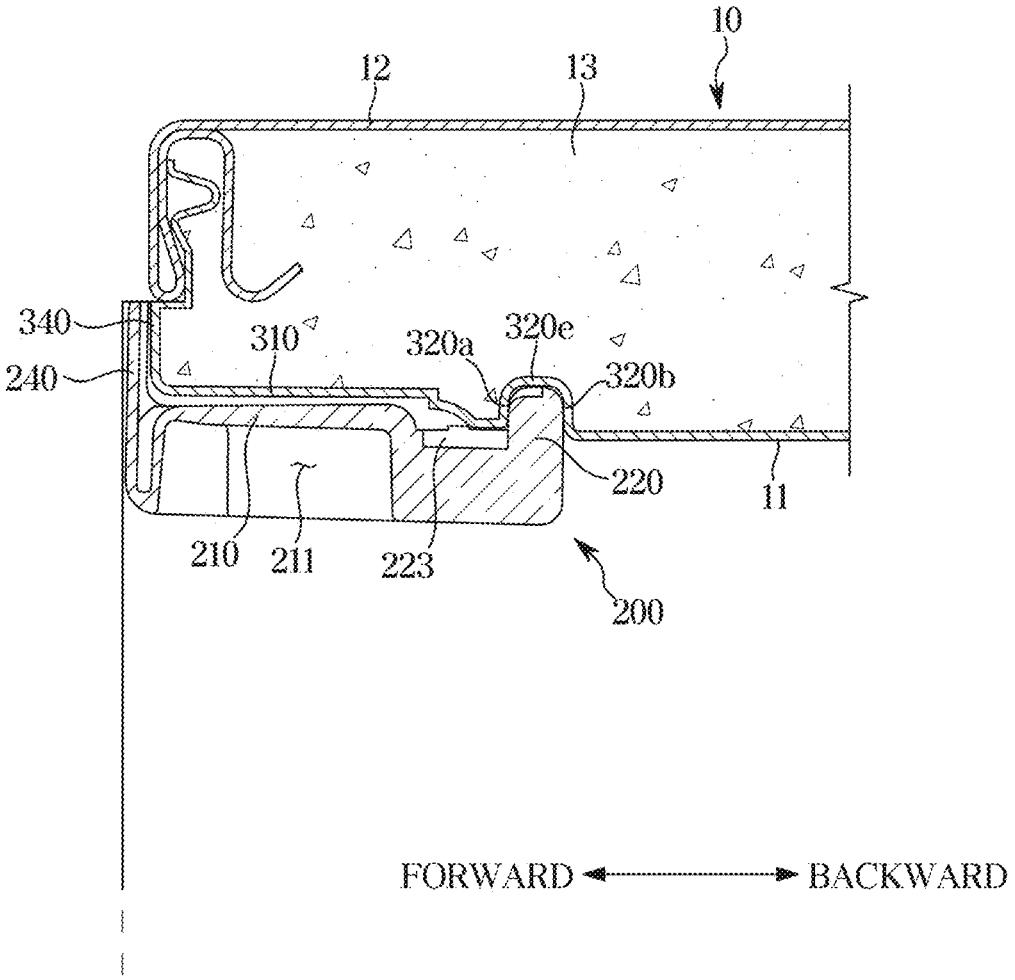
FIG. 11 is a side cross-sectional view illustrating the rotation guide coupled to the inner case of FIG. 1.

FIG. 4 is a view showing the inner case and rotation guide of FIG. 1. FIG. 5 is a view showing the coupling relationship between the inner case of FIG. 1 and the rotation guide. FIG. 6 is a perspective view showing the rotation guide of FIG. 1. FIG. 7 is an enlarged view of A shown in FIG. 6. FIG. 8 is a view showing the rotation guide of FIG. 1 viewed from below. FIG. 9 is a view showing a guide coupling of FIG. 5 viewed from below. FIG. 10 is a side cross-sectional view showing the rotation guide before being coupled to the inner case of FIG. 1. FIG. 11 is a side cross-sectional view showing the rotation guide coupled to the inner case of FIG. 1.

Referring to FIGS. 4 to 11, the rotation guide 200 may be coupled to the inner case 11 and guide the rotating bar 100 to allow for rotation of the rotating bar 100 in response to the opening or closing of the door 30. A portion of the inner case 11 to which the rotation guide 200 is coupled may be referred to as a guide coupling 300. The guide coupling 300 may be formed on an inner surface of the inner case 11, that is, on one surface of the first storage compartment 21 side of the inner case 11.

The guide coupling 300 may be formed on the inner surface located at an upper portion of the inner case 11. In other words, the rotation guide 200 may be disposed on an upper portion of the first storage compartment 21. When the rotation guide 200 is disposed on a lower portion of the first storage compartment 21, there is a problem that foreign substances may enter the guide groove 211 formed in the rotation guide 200. In addition, when the rotation guide 200 is disposed on the lower portion of the first storage compartment 21, the rotation guide 200 may interfere with putting food in or taken food out of the first storage compartment 21. Accordingly, the rotation guide 200 is preferred to be disposed on the upper portion of the first storage compartment 21. However, the present disclosure is not limited thereto, and the rotation guide 200 may be disposed on the lower portion of the first storage compartment 21.

The guide coupling 300 may be formed on a front side of the inner case 11. In other words, the rotation guide 200 may be disposed in front of the first storage compartment 21.

The rotation guide 200 may be constrained from movement thereof by inserting an insertion protrusion 220 into a guide mounting groove 320 of the guide coupling 300. In the constrained state, the rotation guide 200 may be secured to the guide coupling 300 in a screw fastening manner. In the screw fastening manner, at least one screw S passes through a guide fastening hole 231 formed in the rotation guide 200 and an inner case fastening hole 330 formed in the inner case 11, thereby securing the rotation guide 200 to the inner case 11.

The rotation guide 200 may include the guide body 210 forming a body of the rotation guide 200.

At least a portion of the guide body 210 may be accommodated in a guide receiving space 310, which will be described later. The guide body 210 may be secured to the guide receiving space 310 with the screw S through the guide fastening hole 231 formed in the guide body 210 and the inner case fastening hole 330 formed in the guide receiving space 310. However, the method of coupling the guide body 210 to the guide receiving space 310 is not limited thereto. Further details of the guide fastening hole 231 and the inner case fastening hole 330 will be described later.

The guide groove 211 may be formed in the guide body 210 to guide the rotation of the rotating bar 100. The guide groove 211 may have a concave shape so that a portion of the guide protrusion 150 of the rotating bar 100 may be accommodated in the guide groove 211 when the first door 30*a* is closed.

The guide protrusion 150 may be arranged to rotate within the guide groove 211 in response to the opening and closing of the door 30. In other words, the guide body 210 may include a guide wall 212 forming the guide groove 211, and the guide protrusion 150 of the rotating bar 100 may rotate along the guide wall 212 when the first door 30*a* is opened or closed.

As shown in FIG. 8, when the first door 30*a* is closed, the rotating bar 100 disposed on the first door 30*a* may rotate in an r1 direction as the guide protrusion 150 is inserted into the guide groove 211. Conversely, when the first door 30*a* is opened, the rotating bar 100 may rotate in an r2 direction as the guide protrusion 150 is withdrawn from the guide groove 211. In the case where that the rotating bar 100 is disposed on the second door 30*b*, the direction of rotation of the rotating bar 100 upon opening and closing of the second door 30*b* may be in a direction opposite to that described above.

The rotation guide 200 may include a guide opening 211*a* on its front side formed to allow the guide protrusion 150 of the rotating bar 100 to move in and out of the guide groove 211 in response to the opening and closing of the door 30. The guide opening 211*a* may be formed at a position on the rotation guide 200 corresponding to a position of the rotating bar 100 on the first door 30*a*. In other words, the guide opening 211*a* may be formed to be closer to the first door 30*a* relative to the second door 30*b*, and may be formed to be covered by the first door 30*a*. However, the present disclosure is not limited thereto, and when the rotating bar 100 is arranged on the second door 30*b*, the guide opening 211*a* may be formed closer to the second door 30*b* than to the first door 30*a*, and may be formed to be covered by the second door 30*b*.

The guide opening 211*a* may be formed on a front support 240 of the rotation guide 200, which will be described later.

The guide groove 211 and the guide wall 212 forming the guide groove 211 may be formed to have a curved shape. The guide groove 211 and the guide wall 212 may extend from the guide opening 211*a* to a rear side of the refrigerator 1 and may have a curved shape to bend in a lateral direction.

In the case where the rotating bar 100 is disposed on the first door 30*a*, the rotating bar 100 may need to be formed such that when the first door 30*a* is closed, the rotating bar 100 rotates from a position perpendicular to the first door 30*a* towards the second door 30*b* to close the gap between the first door 30*a* and the second door 30*b*. Accordingly, in this case, the guide groove 211 and the guide wall 212 may be formed to have a curved shape from the guide opening 211*a* towards the rear side of the second door 30*b*. However, the present disclosure is not limited thereto, and when the rotating bar 100 is disposed on the second door 30*b*, the guide groove 211 and the guide wall 212 may be formed to have a curved shape from the guide opening 211*a* towards the rear side of the first door 30*a*.

The guide groove 211 may be formed such that the rotating bar 100 is arranged horizontally with the door 30 at one end side opposite to the guide opening 211*a* of the guide groove 211. In other words, the guide groove 211 is formed such that when the guide groove 211 is formed to extend from the guide opening 211*a* toward the rear side of the refrigerator 1 and in a direction in which the second door 30*b* is positioned, the extent to which it extends toward the second door 30*b* may increase as it moves toward the one end side opposite to the guide opening 211*a* of the guide groove 211.

However, the present disclosure is not limited thereto, and as described above, the rotating bar 100 may include the groove structure (not shown) concavely formed at the upper end of the rotating bar 100, and the rotation guide 200 may include the protrusion structure (not shown) formed to be insertable into the groove structure. Upon rotation of the door 30, the groove structure of the rotating bar 100 may be pressed by the protrusion structure of the rotation guide 200, thereby guiding the rotation of the rotating bar 100.

The rotation guide 200 may include the insertion protrusion 220 formed to be inserted into the inner surface of the inner case 11 facing the first storage compartment 21. In particular, the inner case 11 may include the guide mounting groove 320, which will be described later, and the insertion protrusion 220 may have a shape to protrude to be inserted into the guide mounting groove 320.

The rotation guide 200 may be arranged so that the movement of the rotation guide 200 is constrained as the insertion protrusion 220 is inserted into the guide mounting groove 320. In other words, the insertion protrusion 220 may be formed to be constrained in the guide mounting groove 320 to prevent the rotation guide 200 from moving. The specific coupling and constraining relationship between the insertion protrusion 220 and the guide mounting groove 320 will be described later.

The insertion protrusion 220 may include a connection portion 223 connected to the guide body 210 and an insertion portion 221 inserted into the guide mounting groove 320.

The insertion protrusion 220 may extend from the guide body 210 by the connection portion 223. In other words, the insertion protrusion 220 may be connected to the guide body 210 by the connection portion 223.

The insertion protrusion 220 may extend rearwardly from the guide body 210 and be disposed on a rear side of the rotation guide 200. That is, the connection portion 223 may extend rearwardly from the guide body 210. However, the present disclosure is not limited thereto, and the insertion protrusion 220 may be formed at different positions, such as on the side of the rotation guide 200. Alternatively, the insertion protrusion 220 may extend directly upwardly or downwardly from the guide body 210 depending on the arrangement of the guide coupling 300 or the guide mounting groove 320.

In addition, although the single insertion protrusion 220 is shown in FIG. 6 as being formed at the rear of the rotation guide 200, but the present disclosure is not limited thereto. For example, in contrast to FIG. 6, the insertion protrusions 220 may be formed in a plurality on the lateral side of the rotation guide 200 or may be formed in a plurality on the rear side. However, since the rotation guide 200 may be exposed for the user to view the rotation guide 200 when the door 30 is open, the insertion protrusion 220 may be disposed extending to a rear side of the guide body 210 to improve the appearance quality.

The insertion portion 221 of the insertion protrusion 220 may extend from the connection portion 223 in a direction in which it is inserted into the guide mounting groove 320.

More particularly, the insertion portion 221 may extend from the other end opposite to the one end on the guide body 210 side of the connection portion 223 in a direction in which the insertion portion 221 is inserted into the guide mounting groove 320. Accordingly, the insertion protrusion 220 may include a portion extending in one direction from the guide body 210 and a portion extending into the guide mounting groove 320, and thus the insertion protrusion 220 may be formed to include a shape that extends from the guide body 210 as a whole toward the guide mounting groove 320 in a bent manner.

However, the present disclosure is not limited thereto, and the insertion portion 221 may be formed in variety of shapes that may be inserted into the guide mounting groove 320. For example, the insertion portion 221 may extend from an arbitrary point on the connection portion 223 between one end on the guide body 210 side of the connection portion 223 and the other end opposite thereto. Alternatively, depending on the location of the guide mounting groove 320 and the direction in which the insertion protrusion 220 is inserted into the guide mounting groove 320, the connection portion 223 and the insertion portion 221 may extend in the same direction.

The insertion protrusion 220 may have a shape that protrudes upwardly of the rotation guide 200 when the guide coupling 300 is formed on the upper portion of the inner case 11, i.e., when the rotation guide 200 is disposed on the upper portion of the first storage compartment 21. In other words, the insertion portion 221 may extend upwardly from the connection portion 223 and may be inserted into the guide mounting groove 320. As a result, the insertion protrusion 220 may be inserted into the guide mounting groove 320 in the vertical direction. In other words, the insertion protrusion 220 may be inserted into the guide mounting groove 320 in a direction from the lower portion of the inner case 11 toward the upper portion thereof.

The insertion portion 221 may include a first wall 221*a*, a second wall 221*b*, and a third wall 221*c* that form at least a portion of an outer surface of the insertion portion 221. The first wall 221*a*, the second wall 221*b*, and the third wall 221*c* may face at least a portion of inner surfaces 320*a*, 320*b*, 320*c*, 320*d*, and 320*e* of the guide mounting groove 320. Alternatively, the first wall 221*a*, the second wall 221*b*, and the third wall 221*c* may be in contact with at least a portion of the inner surfaces 320*a*, 320*b*, 320*c*, 320*d*, and 320*e* of the guide mounting groove 320. The first wall 221*a* and the second wall 221*b* may be arranged to face each other. The third wall 221*c* may connect the first wall 221*a* and the second wall 221*b*. The third wall 221*c* connecting the first wall 221*a* and the second wall 221*b* may be provided in single pieces as shown in FIGS. 6 and 7, but is not limited thereto. For example, the third walls 221*c* may be provided in a plurality, each connecting the first wall 221*a* and the second wall 221*b*, and may be arranged to face each other.

The first wall 221*a*, the second wall 221*b*, and the third wall 221*c* may be formed to extend in the direction in which the insertion portion 221 is inserted into the guide mounting groove 320. In this case, the first wall 221*a*, the second wall 221*b*, and the third wall 221*c* may be in contact with the first surface 320*a*, the second surface 320*b*, and the third surfaces 320*c* and 320*d* of the guide mounting groove 320, respectively, when the insertion portion 221 is inserted into the guide mounting groove 320. In other words, the insertion portion 221 of the insertion protrusion 220 may arranged to be inserted into the guide mounting groove 320 to be constrained by at least the inner surfaces 320*a*, 320*b*, 320*c*, and 320*d* of the guide mounting groove 320, and to prevent the rotation guide 200 from moving freely. For example, when the insertion protrusion 220 is inserted into the guide mounting groove 320 in the vertical direction, the rotation guide 200 may be constrained in at least in the front-to-back and left-to-right directions to be prevented from moving, even before the guide fastening hole 231 and the inner case fastening hole 330 are fastened to the inner case 11.

In addition, the rotation guide 200 may be constrained in the direction in which the insertion protrusion 220 is inserted into the guide mounting groove 320 before being fastened and secured to the inner case 11. For example, the movement of the rotation guide 200 may be constrained by contacting one end of the insertion portion 221 opposite to the connection portion 223 side to the insertion surface 320*e* of the guide mounting groove 320. In other words, at least a portion of the first wall 221*a*, the second wall 221*b*, and the third wall 221*c* of the insertion portion 221 may contact the insertion surface 320*e*.

Alternatively, the movement of the rotation guide 200 may be constrained by contacting the connection portion 223 to the inner surface of the first storage compartment 21 side of the inner case 11 disposed between the guide receiving space 310 and the guide mounting groove 320. In this case, the movement of the rotation guide 200 in the direction in which the insertion protrusion 220 is mounted in the guide mounting groove 320 before the rotation guide 200 is fasten to the inner case 11 may be constrained even if the first wall 221*a*, the second wall 221*b*, and the third wall 221*c* of the insertion portion 221 do not contact the insertion surface 320*e*.

The insertion protrusion 220 may include an interference protrusion 221*d*. In particular, the insertion portion 221 may include the interference protrusion 221*d* that protrudes toward at least a portion of the inner surfaces 320*a*, 320*b*, 320*c*, 320*d*, and 320*e* of the guide mounting groove 320.

More particularly, the interference protrusion 221*d* may be formed to protrude from at least a portion of the first wall 221*a*, the second wall 221*b*, and the third wall 221*c* of the insertion portion 221 to interfere with at least a portion of the inner surfaces 320*a*, 320*b*, 320*c*, 320*d*, and 320*e* of the guide mounting groove 320.

In particular, the interference protrusion 221*d* may protrude from the outer surface of the insertion portion 221 in a direction different from the direction in which the insertion portion 221 is inserted into the guide mounting groove 320. As a result, the interference protrusion 221*d* may contact and interfere with at least a portion of the first surface 320*a*, the second surface 320*b*, and the plurality of third surfaces 320*c* and 320*d* of the guide mounting groove 320. Accordingly, the interference protrusion 221*d* may prevent the insertion portion 221 from deviating from the guide mounting groove 320.

The direction in which the interference protrusion 221*d* protrudes to prevent the insertion portion 221 from being separated from the guide mounting groove 320 may be parallel to the direction in which the connection portion 223 extends from the guide body 210. However, the present disclosure is not limited thereto, and the direction in which the interference protrusion 221*d* protrudes may be formed in variety of ways. As described above, depending on the arrangement of the guide mounting groove 320, the direction in which the insertion portion 221 is mounted in the guide mounting groove 320 may be aligned with the direction in which the connection portion 223 extends. In this case, in order to prevent the insertion portion 221 from being separated from the guide mounting groove 320, the direction in which the interference protrusion 221*d* protrudes may be different from the direction in which the connection portion 223 extends from the guide body 210.

In FIG. 7, the interference protrusion 221*d* is shown as forwardly protruding from the first wall 221*a* and the second wall 221*b*, but the present disclosure is not limited thereto.

The interference protrusion 221*d* may protrude from the third wall 221*c*, or may protrude from the first wall 221*a* and the second wall 221*b* in a direction different from that shown in FIG. 7. Furthermore, the shape of the interference protrusion 221*d* may not be limited to extending in only one direction. For example, the interference protrusion 221*d* may be formed to extend in the direction in which the insertion portion 221 extends as well as in the direction in which the interference protrusion 221*d* protrudes from the insertion portion 221. For example, in the case shown in FIG. 7, the interference protrusion 221*d* may extend forwardly, which is a direction in which the interference protrusion 221*d* protrudes from the insertion portion 221, and may also extend in the vertical direction in which the insertion portion 221 extends. As the extent to which the interference protrusion 221*d* extends in the extending direction of the insertion portion 221 increases, the area over which the interference protrusions 221*d* interfere with the inner surfaces 320*a*, 320*b*, 320*c*, and 320*d* of the guide mounting groove 320 may increase.

The insertion protrusion 220 including the interference protrusion 221*d* may be integrally injection molded.

The insertion protrusion 220 may form a space on the inside thereof. Accordingly, this may not only reduce the material costs of forming the insertion protrusion 220, but also prevent the insertion protrusion 220 from shrinking when the insertion protrusion 220 is injection molded with resin, as will be described later.

The space formed on the inside of the insertion protrusion 220 described above may be formed on both the inside of the insertion portion 221 and the inside of the connection portion 223.

More particularly, the insertion portion 221 may have the first wall 221*a*, the second wall 221*b*, and the third wall 221*c* arranged on the circumference of the insertion portion 221 to form the outer surface of the insertion portion 221, and a space may be formed between the first wall 221*a*, the second wall 221*b*, and the third wall 221*c*. In this case, the first wall 221*a* and the second wall 221*b* may be spaced apart from each other, and the inner surface of the first wall 221*a* and the inner surface of the second wall 221*b* may be arranged to face each other.

The connection portions 223 may extend from the guide body 210 and be formed to include a plurality of outer walls spaced apart from each other and may form a space between the plurality of outer walls spaced apart from each other.

The insertion protrusion 220 may include a rib 222 on an inner side thereof that supports an inner surface of the insertion protrusion 220. When the space described above is formed on the inner side of the insertion protrusion 220, the rib 222 may support the inner surface of the insertion protrusion 220 and ultimately improve the rigidity of the insertion protrusion 220. At least one rib 222 may be provided, and a plurality of ribs 222 may be formed as needed. The plurality of ribs 222 may be arranged to be spaced apart from each other.

At least a portion of the ribs 222 may extend from the inside of the connection portion 223 along a direction in which the connection portion 223 extends from the guide body 210.

At least another portion of the ribs 222 may extend from the inner side of the insertion portion 221 along a direction in which the insertion portion 221 extends from the connection portion 223.

In other words, the ribs 222 may have a shape that extends bent from the guide body 210 side toward the guide mounting groove 320, inside the insertion protrusion 220.

When the insertion portion 221 extends from one end of the connection portion 223 opposite to the guide body 210 side, the ribs 222 may extend from the inner side of the connection portion 223 along the direction in which the connection portion 223 extends and may also extend along the extending direction of the insertion portion 221 from one end of the connection portion 223 connected to the insertion portion 221.

However, the present disclosure is not limited thereto, and the ribs 222 may have a variety of shapes and arrangements as long as they may supplement the rigidity of the insertion protrusion 220 by supporting the inner surface of the insertion protrusion 220.

The rotation guide 200 may include the front support 240. The front support 240 may be arranged to cover at least a portion of a front surface of the inner case 11 to allow the rotation guide 200 to be supported by the inner case 11. In particular, the front support 240 may be supported by the inner case 11 by being seated in the support groove 340 of the inner case 11, which will be described later.

The front support 240 may be located in front of the rotation guide 200 and may be formed to cover a front surface of the rotation guide 200.

The front support 240 may be disposed on a front side of the guide body 210 and may extend from a front surface of the guide body 210. When the rotation guide 200 is disposed at the upper portion of the first storage compartment 21, the front support 240 may extend to protrude upwardly from the guide body 210 to cover the front surface located at the upper portion of the inner case 11.

The front support 240 may extend in a direction in which the guide groove 211 is concavely formed on the guide body 210. The front support 240 may extend from the guide body 210 longer than the depth at which the guide groove 211 is formed.

The front support 240 may extend along one surface of the guide body 210 exposed from the front side of the first storage compartment 21, i.e., the front surface of the rotation guide 200 facing the first door 30*a* and the second door 30*b*. Furthermore, the front support 240 may be formed to extend from the left side of the rotation guide 200 toward the right side. Accordingly, the front support 240 may cover the entire front surface of the rotation guide 200 except for the portion where the guide opening 211*a* is formed, thereby improving the appearance quality.

The rotation guide 200 may include a fastener 230 for fastening the rotation guide 200 to the inner case 11. The rotation guide 200 may be positioned in the guide coupling 300 at a given position on the inner case 11 by the insertion protrusion 220, and then finally fastened to the inner case 11 by the fastener 230.

The fastener 230 may include the guide fastening hole 231. The guide fastening hole 231 of the fastener 230 may be formed at a position corresponding to the inner case fastening hole 330 of the guide coupling 300. As a result, the screw S may pass through the guide fastening hole 231 and the inner case fastening hole 330 to fasten the rotation guide 200 to the inner case 11.

The guide fastening hole 231 may be formed in the shape of a slot. In particular, the guide fastening hole 231 may be formed to have a longer length in at least one direction relative to the inner case fastening hole 330. As a result, the rotation guide 200 may be easily fastened to the inner case 11 despite any errors in the size or length of the inner case fastening hole 330 that may occur when the inner case fastening hole 330 is formed on the inner case 11.

The fastener 230 may be disposed on the guide body 210. Similarly, the guide fastening hole 231 may be formed in the guide body 210. However, the present disclosure is not limited thereto, and the positions of the fastener 230 and the guide fastening hole 231 may be formed at different positions for securing the rotation guide 200 to the guide coupling 300 of the inner case 11.

The fastener 230 may be formed to protrude from the rotation guide 200 toward the surface where the rotation guide 200 is coupled to the inner case 11, i.e., toward the guide coupling 300. In other words, the fastener 230 may be formed to be in close contact with the guide coupling 300. As a result, the rotation guide 200 may be more stably fastened to the inner case 11 when the rotation guide 200 is fastened to the inner case 11 by the screw S.

The fastener 230 may be formed to protrude from the guide body 210 toward the guide coupling 300. The fastener 230 may be formed to face the guide coupling 300 on the inner side of the guide body 210.

The fastener 230 may be formed in a plurality. In particular, the plurality of fasteners 230 may be formed at positions symmetrical to each other on the rotation guide 200. As a result, the rotation guide 200 may be more securely fastened to the inner case 11.

The rotation guide 200 may be configured to include a plastic material. In particular, the rotation guide 200 may be injection molded including a plastic resin material. Furthermore, the rotation guide 200 may be integrally formed by injection molding. In other words, the guide body 210, the insertion protrusion 220, the fastener 230, the front support 240 and the like of the rotation guide 200 may be injection molded to include a plastic resin material and may be integrally injection molded. In this case, as described above, when the space is formed on the inner side of the insertion protrusion 220 but the ribs 222 are provided, an outer surface of the insertion protrusion 220 may be prevented from shrinking concavely and the rigidity may be supplemented by the ribs 222. However, the present disclosure is not limited thereto, and the rotation guide 200 may be formed in a variety of ways, including different materials. For example, the rotation guide 200 may not be integrally injection molded or may be configured to include a metallic material or the like.

The inner case 11 may include the guide coupling 300 on which the rotation guide 200 is mounted. The guide coupling 300 may be formed on the inner surface of the first storage compartment 21 side of the inner case 11, and may include the guide receiving space 310, the guide mounting groove 320, and the inner case fastening hole 330.

The guide coupling 300 may include the guide receiving space 310 formed to receive at least a portion of the guide body 210 of the rotation guide 200.

The guide receiving space 310 may be formed to be recessed from the inner surface of the first storage compartment 21 side of the inner case 11. As a result, at least a portion of the guide body 210 may be accommodated in the guide receiving space 310, and thus the rotation guide 200 may be securely coupled to the inner case 11. However, the present disclosure is not limited thereto, and the guide receiving space 310 may not include a recessed shape.

The inner case fastening hole 330 for fastening the rotation guide 200 to the inner case 11 may be formed in the guide receiving space 310.

The inner case fastening hole 330 may be formed in the guide receiving space 310 at a position corresponding to the guide fastening hole 231 of the rotation guide 200, and thus the rotation guide 200 and the inner case 11 are arranged to be coupled to each other by the screw S. However, the present disclosure is not limited thereto, and the inner case fastening hole 330 may be formed in a variety of ways as long as it is formed at a position corresponding to the guide fastening hole 231 to fasten the rotation guide 200 to the inner case 11. For example, when the guide fastening hole 231 is formed on the insertion protrusion 220 of the rotation guide 200, the inner case fastening hole 330 may also be formed on the guide mounting groove 320.

The guide fastening hole 231 and the inner case fastening hole 330 may be arranged in parallel to the direction in which the insertion protrusion 220 is inserted into the guide mounting groove 320. In other words, the direction in which the insertion protrusion 220 is inserted into the guide mounting groove 320 may be aligned with the direction in which the rotation guide 200 is fastened to the inner case 11 by the screw S.

The inner case fastening hole 330 may be formed to have a larger diameter than the diameter of the body portion of the screw S that penetrates the guide fastening hole 231 and the inner case fastening hole 330 sequentially. When the inner case fastening hole 330 is formed in the inner case 11, an error may occur compared to a previously intended position where the screw S is coupled. Accordingly, by forming the inner case fastening hole 330 with a large diameter, the screw S may be easily fastened even when an error occurs in the position of the inner case fastening hole 330. Instead, since the rotation guide 200 may be constrained from moving, including the insertion protrusion 220 inserted into the guide mounting groove 320, errors in the position at which the inner case fastening hole 330 is coupled may be reduced even though the position of the inner case fastening hole 330 is somewhat deviated from the originally intended position.

The guide coupling 300 may include the support groove 340 formed on the front surface of the inner case 11 to allow the front support 240 of the rotation guide 200 to be seated. The support groove 340 may have a recessed shape to allow the front support 240 to be seated. A rear surface of the front support 240 may be supported by the support groove 340.

The support groove 340 may be formed to extend from the guide receiving space 310. In particular, when the guide coupling 300 is formed on the upper portion of the inner case 11, the support groove 340 may be formed to extend upwardly from the guide receiving space 310.

The support groove 340 may be formed in a size corresponding to the front support 240. As a result, the front support 240 seated in the support groove 340 may be laterally constrained by the support groove 340.

A hot pipe (not shown) may be provided on the inner side of the inner case 11 to prevent dew condensation from forming along a front edge of the inner case 11. In this case, the support groove 340 may be provided with a heat conduction plate (not shown) configured to transfer heat from the hot pipe to the rotation guide 200 side.

Since the front support 240 is arranged on the front surface of the rotation guide 200 and the support groove 240 is formed on the front surface of the inner case 11, the rotation guide 200 may be supported by the front surface of the inner case 11. However, the present disclosure is not limited thereto, and the rotation guide 200 may not include the front support 240 as long as it includes the insertion protrusion 220 and the fastener 230. Alternatively, the rotation guide 200 may include the front support 240, but the support groove 340 may not be formed on the front surface of the inner case 11.

The guide coupling 300 may include the guide mounting groove 320 having a recessed shape to allow the insertion protrusion 220 of the rotation guide 200 to be inserted.

The guide mounting groove 320 may be formed at a position corresponding to the position of the insertion protrusion 220 of the rotation guide 200. When the insertion protrusion 220 is disposed on the rear side of the guide body 210, the guide mounting groove 320 may be disposed on a rear side of the guide receiving space 310 correspondingly. However, the present disclosure is not limited thereto, and the guide mounting groove 320 may be disposed at different positions that allow the insertion protrusion 220 to be inserted.

The inner case 11 may include the first surface 320*a*, the second surface 320*b*, the third surfaces 320*c* and 320*d*, and the insertion surface 320*e* forming the guide mounting groove 320.

The first surface 320*a* and the second surface 320*b* may be arranged to face each other. When the guide mounting groove 320 is disposed on a rear side of the guide coupling 300, the first surface 320*a* may be a surface arranged in front of the guide mounting groove 320, and the second surface 320*b* may be a surface arranged behind the guide mounting groove 320 and facing the first surface 320*a*. In this case, the front side of the insertion protrusion 220 may face the first surface 320*a*, and the rear side of the insertion protrusion 220 may face the second surface 320*b*.

The third surfaces 320*c* and 320*d* may each be a surface connecting the first surface 320*a* and the second surface 320*b* and may be a surface distinct from the insertion surface 320*e*. The third surfaces 320*c* and 320*d* may be provided in a plurality, and the plurality of third surfaces 320*c* and 320*d* may be arranged to face each other. When the guide mounting groove 320 is disposed on the rear side of the guide coupling 300, the plurality of third surfaces 320*c* and 320*d* may be disposed on the left and right sides of the guide mounting groove 320, respectively.

The insertion surface 320*e* may be a surface disposed in the direction in which the insertion protrusion 220 is inserted into the guide mounting groove 320. That is, the insertion surface 320*e* may be disposed in the direction in which the insertion protrusion 220 is inserted relative to the guide mounting groove 320 and may face an end of the insertion protrusion 220. When the insertion protrusion 220 is inserted into the guide mounting groove 320 in a direction from the lower portion of the inner case 11 to the upper end, the insertion surface 320*e* may be disposed on an upper portion of the guide mounting groove 320 and may face an upper surface of the insertion protrusion 220.

In this case, the outer surface of the insertion protrusion 220 may contact at least a portion of the first surface 320*a*, at least a portion of the second surface 320*b*, and at least a portion of each of the plurality of third surfaces 320*c* and 320*d*. In other words, the outer surface of the insertion protrusion 220 may contact each of the first surface 320*a*, the second surface 320*b*, and the plurality of third surfaces 320*c* and 320*d*. In other words, the first wall 221*a*, the second wall 221*b*, and the third wall 221*c* of the insertion portion 221 may contact the first surface 320*a*, the second surface 320*b*, and the plurality of third surfaces 320*c* and 320*d* of the guide mounting groove 320, respectively.

Referring specifically to the example shown in FIGS. 4 to 11, the first wall 221*a* may contact at least the first surface 320*a* and the third surface 320*c*, the second wall 221*b* may contact at least the first surface 320*a* and the third surface 320*d*, and the third wall 221*c* may contact at least the second surface 320*b*.

Accordingly, the insertion protrusion 220 may be constrained to be unable to move once it is inserted into the inside of the guide mounting groove 320, and the rotation guide 200 may also be prevented from moving relative to the guide coupling 300 of the inner case 11. That is, since the insertion protrusion 220 is inserted into the guide mounting groove 320, the rotation guide 200 may be constrained to be unable to move laterally in the direction in which the insertion protrusion 220 is inserted into the guide mounting groove 320. For example, as shown in FIGS. 4 to 11, the rotation guide 200 may be constrained to be unable to move in the front-to-back and left-to-right directions with respect to the inner case 11. However, the present disclosure is not limited thereto, and the outer surface of the insertion protrusion 220 may contact the first surface 320*a*, the second surface 320*b*, and the third surfaces 320*c* and 320*d* of the guide mounting groove 320, as well as the insertion surface 320*e*.

As such, the insertion protrusion 220 may be inserted into and constrained by the guide mounting groove 320, and thus errors in the position of the rotation guide 200 when the rotation guide 200 is coupled to the inner case 11 may be reduced. In this respect, the guide mounting groove 320 can be considered to serve as a guide to guide the position at which the rotation guide 200 is coupled to the inner case 11.

However, the present disclosure is not limited thereto, and the insertion protrusion 220 may be formed in a variety of ways as long as it is inserted into the guide mounting groove 320 to constrain the movement of the rotation guide 200. For example, the insertion protrusions 220 may be formed in a plurality, and the guide mounting grooves 320 may also be correspondingly formed in a plurality. In this case, the outer surface of the insertion protrusion 220 may not need to be constrained by contacting all of each of the first surface 320*a*, the second surface 320*b*, and the plurality of third surfaces 320*c* and 320*d* forming the guide mounting groove 320. At least a portion of the plurality of insertion protrusions 220 may be inserted into at least a portion of the plurality of guide mounting grooves 320 to be constrained from movement only in the front-to-back direction, and at least another portion of the plurality of insertion protrusions 220 may be inserted into at least another portion of the plurality of guide mounting grooves 320 to be constrained from movement only in the left-to-right direction.

Meanwhile, as described above, the insertion protrusion 220 may include an interference protrusion 221*d* that interferes with at least a portion of the inner surfaces 320*a*, 320*b*, 320*c*, 320*d*, and 320*e* of the guide mounting groove 320. In particular, to prevent the insertion portion 221 from being separated from the guide mounting groove 320, the interference protrusion 221*d* may protrude to contact at least a portion of the first surface 320*a*, the second surface 320*b*, and the third surfaces 320*c* and 320*d* of the guide mounting groove 320.

In the above configuration, the rotation guide 200 may be constrained by inserting the insertion protrusion 220 into the guide mounting groove 320 before the rotation guide 200 is coupled to the inner case 11. By inserting the insertion protrusion 220 into the guide mounting groove 320 and then the rotation guide 200 is coupled to the inner case 11 by means of the screw S, errors in the position at which the rotation guide 200 is coupled to the inner case 11 may be reduced.

Figure 12:
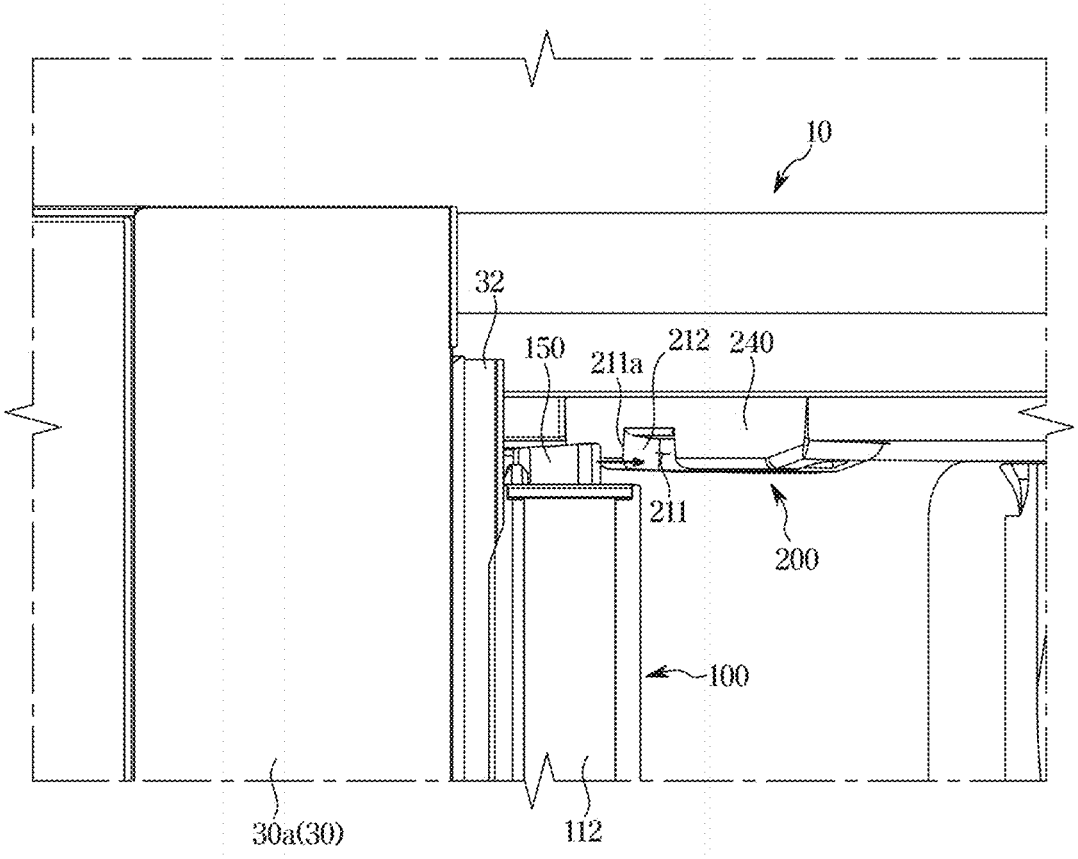
FIGS. 12 and 13 are views illustrating an operation of the rotating bar in response to opening and closing of the door.
Figure 13:
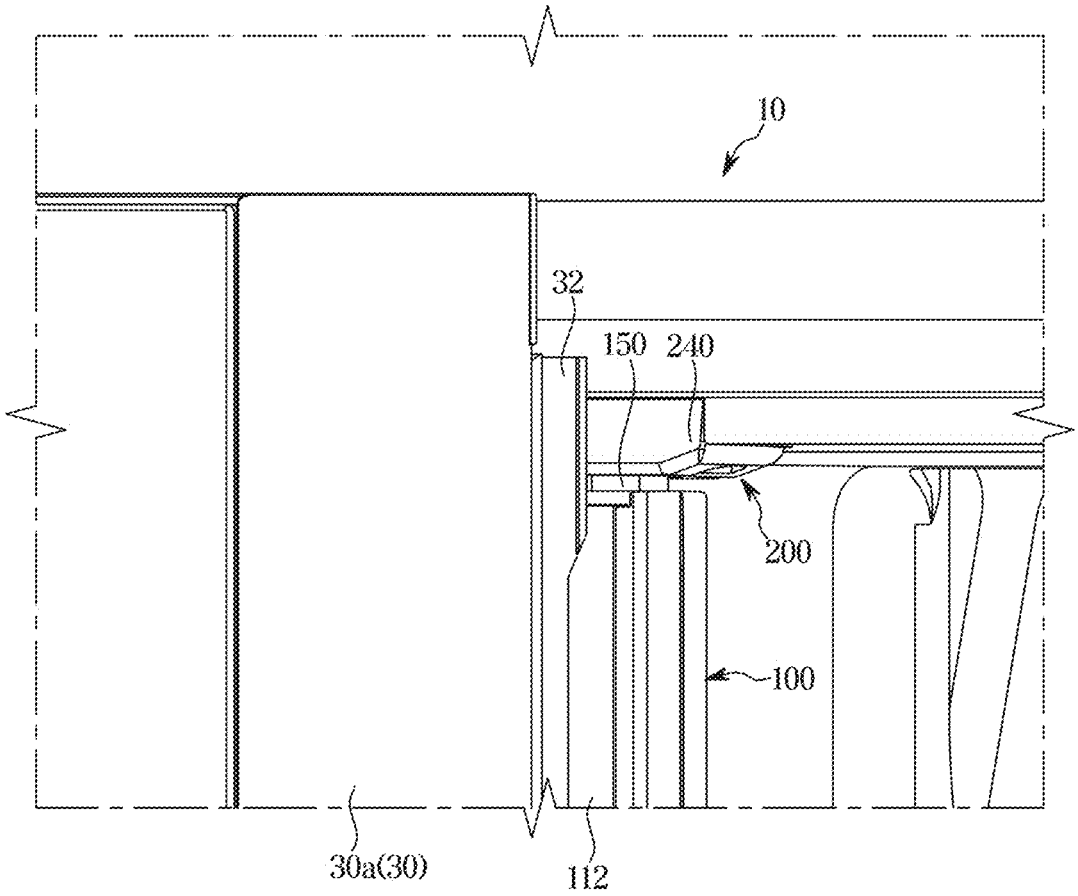

FIGS. 12 and 13 are view showing an operation of the rotating bar in response to the opening and closing of the door.

Referring to FIGS. 12 and 13, the rotating bar 100 may be rotatably arranged on the door 30. Although the rotating bar 100 is shown in FIGS. 12 and 13 as being mounted on the first door 30*a*, but the rotating bar 100 is not limited thereto and may be rotatably mounted on the second door 30*b*.

As shown in FIG. 12, when the first door 30*a* is open, the rotating bar 100 may be in the first position disposed perpendicular to the first door 30*a*.

As shown in FIG. 13, when the first door 30*b* is closed, the rotating bar 100 may be in the second position disposed approximately parallel to the first door 30*a*. In other words, when the first door 30*a* is closed, the second cover 112 of the rotating bar 100 may be arranged to face the front side of the refrigerator 1 and may be arranged to face the inner surface of the door 30. When the first door 30*a* and the second door 30*b* are closed, the rotating bar 100 may be disposed in the second position to cover the gap between the first door 30*a* and the second door 30*b* and to prevent cold air in the first storage compartment 21 from escaping.

When the first door 30*a* is rotated from an open state to a closed state, the rotating bar 100 may be inserted into the guide groove 211 through the guide opening 211*a* of the rotation guide 200. In particular, when the first door 30*a* is closed, the guide protrusion 150 of the rotating bar 100 may be inserted into the inner side of the guide groove 211 through the guide opening 211*a*. The guide protrusion 150 may be gradually pressed by the guide wall 212 as the first door 30*a* is rotated to close, and the rotating bar 100 may be guided to rotate from the first position to the second position by the guide groove 211.

When the first door 30*a* is rotated from the closed state to the open state, the guide protrusion 150 may be pressed by the guide wall 212 on the inner side of the guide groove 211, and the rotating bar 100 may be guided to rotate from the second position to the first position by the guide groove 211. Eventually, the guide protrusion 150 may be withdrawn from the guide groove 211 to the outside of the rotation guide 200 through the guide opening 211*a* as the first door 30*a* is rotated to open.

As the first door 30*a* is opened or closed, the guide protrusion 150 may be guided and rotated in the inner side of the guide groove 211, and the directions in which the rotating bar 100 rotates (i.e., r1 and r2 directions) may be the same as those described in FIG. 8.

Figure 14:
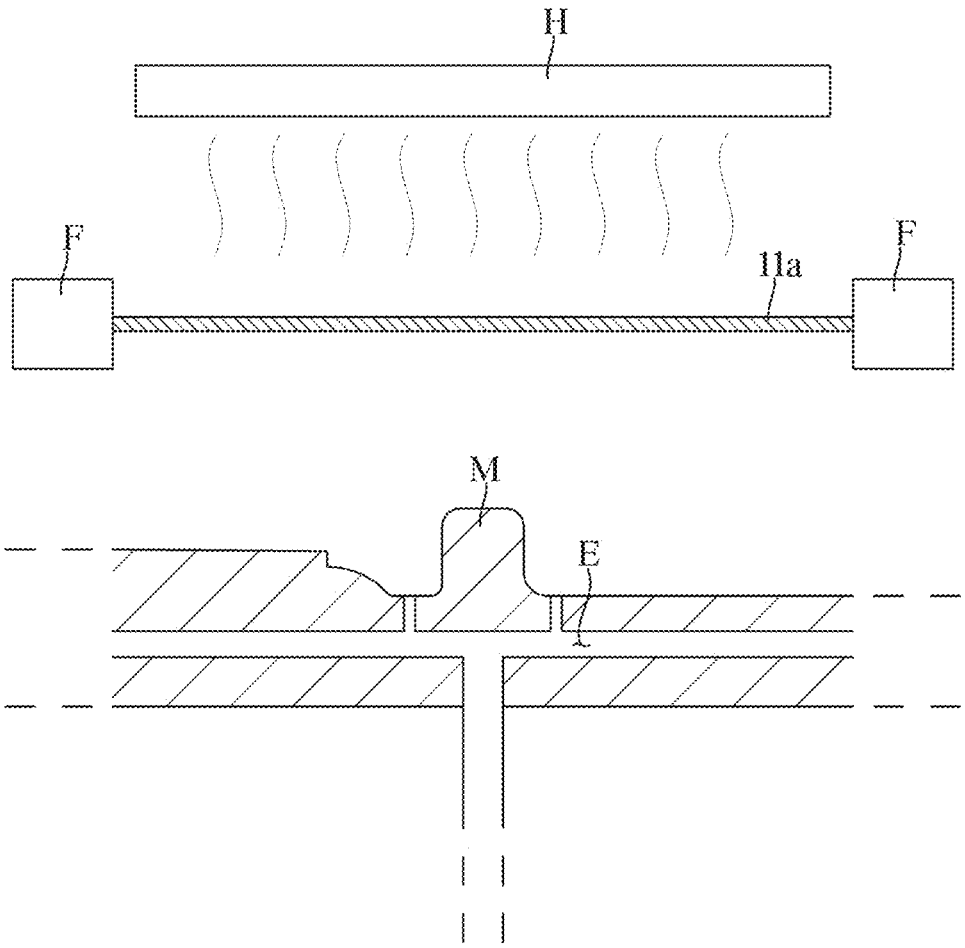
FIGS. 14 and 15 are schematic views illustrating manufacturing of the inner case according to an embodiment of the present disclosure.
Figure 15:
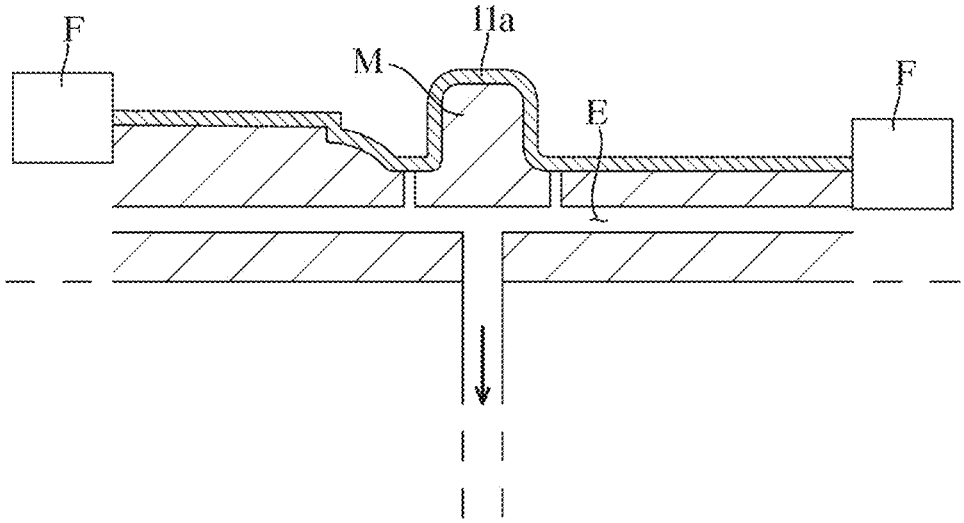

FIGS. 14 and 15 are schematic views showing the manufacturing of the inner case according to an embodiment of the present disclosure.

Referring to FIGS. 14 and 15, the guide mounting groove 320 may be molded integrally with the inner case 11 by a vacuum molding process. That is, in the process of manufacturing the inner case 11 by a vacuum molding process, the guide mounting groove 320 may be simultaneously formed on one surface of the inner case 11.

To manufacture the inner case 11 by a vacuum molding process, a mold M including an inner case sheet 11*a* configured as a material forming the inner case 11, a heater H, a fixing member F, an exhaust passage E, and the like may be required.

The inner case sheet 11*a* may be the configuration before the inner case 11 is vacuum molded, and the inner case sheet 11*a* may be configured to include a plastic resin material.

As shown in FIG. 14, the inner case sheet 11*a* may be fixed by the fixing member F, and may be heated by the heater H. The inner case sheet 11*a* may be heated by the heater H to soften the heated inner sheet to facilitate molding.

The softened inner case sheet 11*a* may be brought into contact with the mold M as shown in FIG. 15. At this time, the fixing member For the mold M may be moved such that the inner case sheet 11*a* is in contact with the mold M.

When the inner case sheet 11*a* is in contact with the mold M, the inner case sheet 11*a* side of the mold M may be in communication with the outside, and air may be discharged to an opposite side of the inner case sheet 11*a* through the exhaust passage E formed in the interior of the mold M, as shown in FIG. 15. As a result, the air between the inner case sheet 11*a* and the mold M may be discharged to the opposite side of the inner case sheet 11*a* through the exhaust passage E, so that the inner case sheet 11*a* may be adsorbed (e.g., vacuum absorb) on the surface of the mold M.

The mold M may be manufactured in a shape corresponding to the shape of the inner case 11 to be manufactured, so that when the inner case sheet 11*a* is adsorbed on the mold M, the inner case sheet 11*a* may be molded in a shape corresponding to the shape of the mold M.

FIGS. 14 and 15 show the mold M for molding the inner case 11, in particular a portion of the mold M for molding the guide coupling 300 including the guide mounting groove 320 and its surroundings.

In such a way, the guide mounting groove 320, which has a concave shape to allow the insertion protrusion 220 of the rotation guide 200 to be inserted therein, may be formed integrally with the inner case 11 in the process of forming the inner case 11.

In contrast, if a configuration such as a hole for mounting the rotation guide 200 to the inner case 11 is machined in a separate process after the inner case 11 is molded, errors may occur during the process. For example, if the inner case fastening hole 330 for fastening the rotation guide 200 to the inner case 11 is machined by a drilling process after molding the inner case 11, an error in the inner case fastening hole 330 may occur. Accordingly, the rotation guide 200 may not be easily coupled to the inner case 11. Otherwise, the rotation guide 200 may not be reliably coupled to the inner case 11, resulting in an inability to sufficiently cover the gap between the doors 30*a* and 30*b*, or a deterioration in the appearance quality.

When the guide mounting groove 320 is integrally molded with the inner case 11 by the vacuum molding method as shown in FIGS. 14 and 15, errors in dimensions, including the position at which the rotation guide 200 is mounted, may be reduced.

However, the method of molding the inner case 11 including the guide mounting groove 320 shown in FIGS. 14 and 15 may be only an example, and the ideas according to the present disclosure are not limited thereto.

Hereinafter, a method of manufacturing a refrigerator according to an embodiment of the present disclosure will be described in detail.

To manufacture a refrigerator according to an embodiment of the present disclosure, a process for forming the outer case 12 that forms the exterior of the refrigerator 1 may be included. The outer case 12 may be formed of a metallic material or the like, and may be formed by assembling a plurality of panels to form the outer case 12 or by a process of pressing the panels.

The inner case 11 may be formed such that the guide mounting groove 320 is integrally formed as described above. In particular, as described above, the inner case 11 may be manufactured simultaneously with the guide mounting groove 320, which is formed integrally with the inner case 11 by a vacuum molding process.

The rotation guide 200 formed to guide the rotation of the rotating bar 100 may be formed to include the insertion protrusion 220. In particular, the rotation guide 200 may be injection molded. The rotation guide 200 including the insertion protrusion 220 may be configured to include a plastic material, as described above, and may be integrally injection molded.

After both the inner case 11 including the guide mounting groove 320 and the rotation guide 200 including the insertion protrusion 220 are manufactured, the rotation guide 200 may be mounted on the inner case 11 by inserting the insertion protrusion 220 into the guide mounting groove 320. Then, as described above, the rotation guide 200 may be screwed to the inner case 11 through the guide fastening hole 231. As a result, the rotation guide 200 may be coupled to be fixed to the inner case 11.

Manufacturing the door 30 rotatably coupled to the main body 10 may include manufacturing the first door 30*a* and the second door 30*b* and manufacturing the rotating bar 100. Then, the rotating bar 100 may be rotatably coupled to the first door 30*a* or the second door 30*b*.

After the above processes, the inner case 11 may be positioned on the inner side of the outer case 12, and then the insulation 13 may be foamed between the outer case 12 and the inner case 11, so that the outer case 12 and the inner case 11 may be mutually coupled to each other and the first door 30*a* and the second door 30*b* may be rotatably coupled to the outer case 12. The first door 30*a* and the second door 30*b* may be rotatably coupled to the outer case 12 by hinges (not shown).

However, the order of the processes for manufacturing the refrigerator 1 according to the present disclosure is not limited to the order described above. For example, the refrigerator 1 may be manufactured by preparing the outer case 12 and the inner case 11, foaming the insulation 13 to join the outer case 12 and the inner case 11 to form the main body 10, and then coupling the rotation guide 200 to the inner case 11. Alternatively, after forming the main body 10 by joining the outer case 12 and the inner case 11, and rotatably coupling the door 30, to which the rotating bar 100 is coupled, to the main body 10, the rotation guide 200 may be coupled to the inner case 11.

According to the spirit of the present disclosure, the rotation guide 200 may be mounted on one surface of the first storage compartment 21 of the inner case 11 that may be exposed to the outside upon when the door 30 is opened. Accordingly, coupling the rotation guide 200 to the inner case 11 may not be limited to whether the outer case 12 or the door 30 is assembled, as long as the inner case 11 including the guide mounting groove 320 is manufactured.

In this way, the refrigerator 1 according to an embodiment of the present disclosure may be manufactured.

While the present disclosure has been particularly described with reference to exemplary embodiments, it should be understood by those of skilled in the art that various changes in form and details may be made without departing from the spirit and scope of the present disclosure.

Although the present disclosure has been described with various embodiments, various changes and modifications may be suggested to one skilled in the art. It is intended that the present disclosure encompass such changes and modifications as fall within the scope of the appended claims.

What is claimed is:

1. A refrigerator comprising:

an outer case forming an exterior thereof;

an inner case forming a storage compartment, and including a guide receiving space and a surface forming a guide mounting groove formed integrally with the inner case, the surface including a first surface, a second surface disposed to face the first surface, a plurality of third surfaces connecting the first surface and the second surface, and an insertion surface;

an insulation foamed between the outer case and the inner case;

a first door rotatably coupled to the outer case to open or close at least a portion of the storage compartment;

a second door disposed on a right side of the first door and rotatably coupled to the outer case to open or close at least another portion of the storage compartment;

a rotating bar configured to be rotatable with respect to one of the first door and the second door and cover a gap between the first door and the second door when the first door and the second door are closed; and a rotation guide disposed on an upper portion of the storage compartment to guide the rotating bar to allow rotation of the rotating bar in response to opening or closing of the first door or the second door, and including a guide body at least partially accommodated in the guide receiving space and an insertion protrusion inserted into the guide mounting groove in a direction from a lower portion toward an upper portion of the inner case to prevent movement of the rotation guide, wherein the insertion surface of the inner case is disposed in a direction in which the insertion protrusion is inserted into the guide mounting groove, and wherein an outer surface of the insertion protrusion is formed to contact at least a portion of the first surface, at least a portion of the second surface, and at least a portion of each of the plurality of third surfaces, and wherein the insertion protrusion includes an interference protrusion that protrudes in a direction different from the direction in which the insertion protrusion is inserted into the guide mounting groove.

2. The refrigerator of claim 1, wherein the insertion protrusion is disposed on a rear side of the guide body.

3. The refrigerator of claim 1, wherein:

the insertion protrusion includes a connection portion connected to the guide body and an insertion portion inserted into the guide mounting groove, and the insertion portion extends from the connection portion in a direction in which the insertion portion is inserted into the guide mounting groove.

4. The refrigerator of claim 3, wherein:

the connection portion extends rearwardly from the guide body, and the insertion portion extends upwardly from the connection portion.

5. The refrigerator of claim 3, wherein the insertion portion extends from a first end opposite to a second end on a side of the connection portion adjacent to the guide body.

6. The refrigerator of claim 3, wherein:

the insertion portion includes a first wall, a second wall disposed to face the first wall, and a third wall connecting the first wall and the second wall, the first wall, the second wall, and the third wall form at least a portion of an outer surface of the insertion portion, and are formed to extend in the direction in which the insertion portion is inserted into the guide mounting groove.

7. The refrigerator of claim 6, wherein:

the interference protrusion is formed to protrude toward an inner surface of the guide mounting groove from at least a portion of the first wall, the second wall, and the third wall, and the interference protrusion interferes with the inner surface of the guide mounting groove when the insertion portion is inserted into the guide mounting groove.

8. The refrigerator of claim 3, wherein the insertion protrusion includes a rib configured to support an inner surface of the insertion protrusion therein.

9. The refrigerator of claim 8, wherein:

at least a portion of the rib extends inside the connection portion along a direction in which the connection portion extends from the guide body, and at least another portion of the rib extends inside the insertion portion along a direction in which the insertion portion extends from the connection portion.

10. The refrigerator of claim 1, wherein the guide body includes a guide fastening hole formed to fasten the rotation guide to the inner case.

11. The refrigerator of claim 10, wherein the guide fastening hole is configured to fasten the rotation guide to the inner case in a direction in which the insertion protrusion is inserted into the guide mounting groove.

12. The refrigerator of claim 1, wherein:

the guide body further includes a guide groove guiding the rotation of the rotating bar, and the rotating bar includes a guide protrusion moving along the guide groove so as to guide the rotation of the rotating bar.

13. A refrigerator comprising:

an outer case forming an exterior thereof;

an inner case forming a storage compartment and including a guide mounting groove formed integrally with the inner case, a guide receiving space, and an inner case fastening hole;

an insulation foamed between the outer case and the inner case;

a door to open or close the storage compartment and including a first door and a second door adjacent to the first door;

a rotating bar rotatably coupled to one of the first door and the second door and formed to cover a gap between the first door and the second door when the first door and the second door are closed; and a rotation guide to guide the rotating bar to allow rotation of the rotating bar in response to opening or closing of the one of the first door or the second door to which the rotating bar is coupled, the rotation guide including a guide body having at least a portion thereof accommodated in the guide receiving space, a guide fastening hole formed to be screwed into the inner case fastening hole, and an insertion protrusion inserted into the guide mounting groove in a vertical direction to constrain the rotation guide from movement, wherein the guide fastening hole and the inner case fastening hole are aligned with the vertical direction in which the insertion protrusion is inserted into the guide mounting groove, and wherein the insertion protrusion includes an interference protrusion that protrudes in a direction different from the direction in which the insertion protrusion is inserted into the guide mounting groove.

14. The refrigerator of claim 13, wherein the insertion protrusion includes a connection portion connected to the guide body and an insertion portion inserted into the guide mounting groove and extending from a first end opposite to a second end of a side of the connection portion with the guide body toward the guide mounting groove.

15. The refrigerator of claim 14, wherein the interference protrusion is formed to protrude toward an inner surface of the guide mounting groove and interfere with the inner surface of the guide mounting groove.

* * * * *